US008870361B2

(12) United States Patent
Tasaka et al.

(10) Patent No.: US 8,870,361 B2
(45) Date of Patent: Oct. 28, 2014

(54) PRINTING DEVICE, PRINTING METHOD, SHEET-FED PRINTING PRESS, AND ROTARY PRINTING PRESS

(75) Inventors: Norifumi Tasaka, Mihara (JP); Makoto Kaji, Mihara (JP); Shuichi Takemoto, Mihara (JP); Fumihide Kimura, Mihara (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 112 days.

(21) Appl. No.: 13/259,028

(22) PCT Filed: Mar. 23, 2010

(86) PCT No.: PCT/JP2010/055005

§ 371 (c)(1), (2), (4) Date: Sep. 22, 2011

(87) PCT Pub. No.: WO2010/110276

PCT Pub. Date: Sep. 30, 2010

(65) Prior Publication Data

US 2012/0013693 A1 Jan. 19, 2012

(30) Foreign Application Priority Data

Mar. 24, 2009 (JP) ..... 2009-071848

(51) Int. Cl.

| | |
|---|---|
| ***B41J 2/01*** | (2006.01) |
| ***B41J 11/00*** | (2006.01) |
| ***B41M 5/03*** | (2006.01) |
| ***B41F 23/04*** | (2006.01) |
| ***B41M 7/00*** | (2006.01) |
| ***B41F 7/12*** | (2006.01) |
| ***B41F 19/00*** | (2006.01) |
| ***B41J 2/005*** | (2006.01) |
| ***B41M 5/025*** | (2006.01) |

(52) U.S. Cl.

CPC ..... *B41M 5/0256* (2013.01); *B41J 11/002* (2013.01); *B41M 5/03* (2013.01); *B41F 23/0403* (2013.01); *B41M 7/0081* (2013.01); *B41F 7/12* (2013.01); *B41F 19/00* (2013.01); *B41M 7/00* (2013.01); *B41J 2/0057* (2013.01)

USPC ..... 347/102; 347/101; 347/104

(58) Field of Classification Search

CPC ..... B41J 2/01; B41J 11/002; B41J 11/0015; B41M 7/0072; C09D 11/101

USPC ..... 347/96–102; 101/488; 219/216; 346/25; 399/320

See application file for complete search history.

(56) References Cited

U.S. PATENT DOCUMENTS 7,494,213 B2 * 2/2009 Taniuchi et al. ..... 347/103

(Continued)

FOREIGN PATENT DOCUMENTS

JP 62-092849 4/1987

(Continued)

OTHER PUBLICATIONS

Japanese Office Action for Application No. 2009-071848 mailed May 8, 2012.

(Continued)

*Primary Examiner* — Manish S Shah
*Assistant Examiner* — Jeremy Delozier
(74) *Attorney, Agent, or Firm* — Lowe Hauptman & Ham, LLP

(57) ABSTRACT

A printing device includes a rotatable printing cylinder, a blanket cylinder configured to make a synchronous rotation with the printing cylinder in contact with each other and to convey a printing medium by nipping the printing medium with the printing cylinder, an inkjet head that forms an image on a surface of the blanket cylinder by squirting heatset ink onto the surface of the blanket cylinder, and a first heating unit that heats up either the printing medium conveyed into a contact portion of the printing cylinder and the blanket cylinder or the blanket cylinder.

7 Claims, 11 Drawing Sheets

(56) References Cited

U.S. PATENT DOCUMENTS

| | | | | |
|---|---|---|---|---|
| 7,556,368 | B2 * | 7/2009 | Gervasi et al. | 347/103 |
| 8,220,917 | B2 * | 7/2012 | Taniuchi et al. | 347/103 |
| 8,256,345 | B2 * | 9/2012 | Denninger et al. | 101/424.1 |
| 2005/0036023 | A1 | 2/2005 | Costanza et al. | |
| 2006/0066704 | A1 | 3/2006 | Nishida | |
| 2006/0164488 | A1 | 7/2006 | Taniuchi et al. | |
| 2007/0291092 | A1 | 12/2007 | Gervasi et al. | |
| 2009/0050008 | A1 * | 2/2009 | Miwa | 101/424.1 |
| 2009/0128610 | A1 | 5/2009 | Taniuchi et al. | |

FOREIGN PATENT DOCUMENTS

| | | | | |
|---|---|---|---|---|
| JP | 08-290543 | * | 11/1996 | B41F 13/46 |
| JP | 8-290543 | A | 11/1996 | |
| JP | 08-309961 | | 11/1996 | |
| JP | 10-286939 | | 10/1998 | |
| JP | 11-291605 | | 10/1999 | |
| JP | 11-320851 | | 11/1999 | |
| JP | 2000-158623 | | 6/2000 | |
| JP | 2000-103035 | | 11/2000 | |
| JP | 2001-080750 | * | 3/2001 | B41F 21/00 |
| JP | 2001-080750 | A | 3/2001 | |
| JP | 2002-011865 | | 1/2002 | |
| JP | 2002-166532 | A | 6/2002 | |
| JP | 2002361833 | | 12/2002 | |
| JP | 2003-026962 | | 1/2003 | |
| JP | 2003-223066 | | 8/2003 | |
| JP | 2003-305829 | | 10/2003 | |
| JP | 2004-114675 | A | 4/2004 | |
| JP | 2005-059598 | A | 3/2005 | |
| JP | 2005-343049 | | 12/2005 | |
| JP | 2006-123537 | A | 5/2006 | |
| JP | 2006-130725 | A | 5/2006 | |
| JP | 2007-276466 | | 10/2007 | |
| JP | 2008-001102 | A | 1/2008 | |
| JP | 2008-019286 | | 1/2008 | |

OTHER PUBLICATIONS

International Search Report for PCT/JP2010/055005 mailed May 25, 2010.

Office Action issued in Japanese Application No. 2009-071848, dated Apr. 30, 2013.

Decision of a Patent Grant mailed Mar. 4 2014, corresponds Japanese patent application No. 2009-071848.

* cited by examiner

OFFSET SHEET-FED PRINTING PRESS ACCORDING TO FIRST EMBODIMENT

OFFSET SHEET-FED PRINTING PRESS ACCORDING TO SECOND EMBODIMENT

OFFSET SHEET-FED PRINTING PRESS ACCORDING TO THIRD EMBODIMENT

OFFSET SHEET-FED PRINTING PRESS ACCORDING TO FOURTH EMBODIMENT

OFFSET SHEET-FED PRINTING PRESS ACCORDING TO FIFTH EMBODIMENT

OFFSET SHEET-FED PRINTING PRESS ACCORDING TO SIXTH EMBODIMENT

OFFSET SHEET-FED PRINTING PRESS ACCORDING TO NINTH EMBODIMENT

PRINTING DEVICE, PRINTING METHOD, SHEET-FED PRINTING PRESS, AND ROTARY PRINTING PRESS

RELATED APPLICATIONS

The present application is a National Phase of International Application Number PCT/JP2010/055005, filed Mar. 23, 2010 and claims priority from, Japanese Application Number 2009-071848, filed Mar. 24, 2009.

FIELD

The present invention relates to a printing device and a printing method for performing printing using an inkjet head and a sheet-fed printing press and a rotary printing press using the printing device.

BACKGROUND

As a printing device that performs printing using an inkjet head, printing devices described in Patent Literatures 1 and 2 have been known. The inkjet printing device described in Patent Literature 1, which includes a blanket cylinder, a plurality of nozzles arranged facing the blanket cylinder, and an impression roller that keeps a constant nip width with the blanket cylinder, records an ink image on the blanket cylinder by squirting droplets of ink onto the blanket cylinder and transfers the ink image onto printing paper at a contact portion of the blanket cylinder and the impression roller by rotating the blanket cylinder.

An offset printing method using an inkjet system described in Patent Literature 2 includes printing a UV ink image on a flat original plate by inkjet using UV heatset ink, half drying the UV ink image by irradiating the image with UV or electron beam, transferring the half dried UV ink image to a surface of an elastic blanket, offset-printing the UV ink image transferred to the elastic blanket to a printing object, and fixing the offset-printed UV ink image by drying.

CITATION LIST

Patent Literatures

Patent Literature 1: Japanese Patent Application Laid-open No. 2002-166532

Patent Literature 2: Japanese Patent Application Laid-open No. 2006-130725

SUMMARY

Technical Problem

In the inkjet printing device described in Patent Literature 1, the ink image is recorded on the blanket cylinder by the inkjet head, and the ink image is then transferred onto the printing paper. In general, in a printing device that performs printing using the inkjet head, because the image (picture or text) is formed on a target object by squirting ink from a plurality of nozzles, ink having a low degree of viscosity is used. Therefore, in a conventional inkjet printing press, the ink could penetrate into the printing paper when transferring the ink image onto the printing paper, possibly causing degradation of printing accuracy.

In the offset printing method using the inkjet system described in Patent Literature 2, the UV ink image printed on the flat original plate is half dried by irradiating the image with the UV or the electron beam, the half dried UV ink image is transferred onto the surface of the elastic blanket, and the offset printing is performed on a printing body. In this case, there is a problem that the use of the UV ink causes an increase of printing cost.

The present invention has been achieved in view of the above aspects, and it is an object of the present invention to provide a printing device, a printing method, a sheet-fed printing press, and a rotary printing press that can enhance the printing accuracy and suppress the increase of the printing cost.

Solution to Problem

According to an aspect of the present invention, a printing device includes: a rotatable printing cylinder; a blanket cylinder configured to make a synchronous rotation with the printing cylinder in contact with each other and to convey a printing medium by nipping the printing medium with the printing cylinder; an inkjet head that forms an image on a surface of the blanket cylinder by squirting heatset ink onto the surface of the blanket cylinder; and a first heating unit that heats up either the printing medium conveyed into a contact portion of the printing cylinder and the blanket cylinder or the blanket cylinder.

Advantageously, in the printing device, the first heating unit heats up a printing surface of the printing medium before the image is transferred from the blanket cylinder.

Advantageously, in the printing device, the first heating unit heats up the surface of the blanket cylinder before the heatset ink is squirted from the inkjet head.

Advantageously, the printing device further includes a second heating unit that heats up an image transferred from the blanket cylinder onto the printing medium.

Advantageously, the printing device, further includes a preliminary heating unit that preliminarily heats up the image formed on the surface of the blanket cylinder.

Advantageously, the printing device, further includes a cleaning unit that removes residual heatset ink remained on the surface of the blanket cylinder after the image formed on the surface of the blanket cylinder is transferred onto the printing medium.

According to another aspect of the present invention, a printing method includes: heating either a rotating blanket cylinder or a printing medium conveyed into a contact portion of the blanket cylinder and a printing cylinder; forming an image on a surface of the blanket cylinder by squirting heatset ink onto the surface of the blanket cylinder; and transferring the image formed on the blanket cylinder onto the printing medium at the contact portion of the blanket cylinder and the printing cylinder.

Advantageously, the printing method further includes drying the image transferred onto the printing medium by heating the image.

According to still another aspect of the present invention, a sheet-fed printing press includes: a feeder device that sucks and sends out cut paper stacked on a feeder pile board; a printing device that conveys the cut paper sent from the feeder device by nipping the cut paper between a printing cylinder and a blanket cylinder and performs printing by transferring an image formed on the blanket cylinder onto the cut paper; and a delivery device that delivers the cut paper on which the printing is performed by the printing device by stacking the cut paper on a delivery pile board. The printing device includes an inkjet head that forms the image on a surface of the blanket cylinder by squirting heatset ink onto the surface of the blanket cylinder, and a first heating unit that heats up either the printing medium conveyed into a contact portion of the printing cylinder and the blanket cylinder or the blanket cylinder.

According to still another aspect of the present invention, a rotary printing press includes: a feeder device that supplies a web from a paper roll; a printing device that conveys the web sent from the feeder device by nipping the web between a printing cylinder and a blanket cylinder and performs printing by transferring an image formed on the blanket cylinder onto the web; a drying device that dries the web on which the printing is performed by the printing device; a folding device that cuts the web dried by the drying device and folds a cut web to form a quire; and a delivery device that delivers the quire formed by the folding device. The printing device includes an inkjet head that forms the image on a surface of the blanket cylinder by squirting heatset ink onto the surface of the blanket cylinder, and a first heating unit that heats up either the printing medium conveyed into a contact portion of the printing cylinder and the blanket cylinder or the blanket cylinder.

Advantageous Effects of Invention

With the printing device according to the present invention, the printing medium can be conveyed by being nipped between the printing cylinder and the blanket cylinder, and the inkjet head that forms an image on a surface of the blanket cylinder by squirting heatset ink onto the surface of the blanket cylinder and a first heating unit that heats up either the printing medium conveyed into a contact portion of the printing cylinder and the blanket cylinder or the blanket cylinder are provided. Therefore, by heating up the printing medium or the blanket cylinder in advance by the first heating unit, the heatset ink of the image formed on the surface of the blanket cylinder by the inkjet head is dried on the printing medium or the blanket cylinder, by which the ink does not penetrate into the printing medium so that the printing accuracy can be enhanced, and furthermore, it is possible to suppress the increase of cost without using expensive ink.

Furthermore, with the printing device according to the present invention, because the first heating unit heats up the printing surface of the printing medium before the image is transferred from the blanket cylinder, the heatset ink forming the image is primarily dried when transferring the image from the blanket cylinder onto the printing medium, so that it is possible to dry the ink at an early stage.

With the printing device according to the present invention, because the first heating unit heats up the surface of the blanket cylinder before the heatset ink is squirted from the inkjet head, the image is primarily dried when the heatset ink is squirted onto the surface of the blanket cylinder from the inkjet head, so that it is possible to dry the ink at an early stage.

With the printing device according to the present invention, because the second heating unit that heats up an image transferred from the blanket cylinder onto the printing medium is provided, the heatset ink of the image formed on the surface of the blanket cylinder by the inkjet head is primarily dried on the printing medium or the blanket cylinder, and thereafter, the heatset ink is secondarily dried by the second heating unit, by which it is possible to dry the ink at an early stage.

With the printing device according to the present invention, because the preliminary heating unit that preliminarily heats up the image formed on the surface of the blanket cylinder is provided, it is possible to dry the ink of the image formed on the surface of the blanket cylinder in an appropriate manner.

With the printing device according to the present invention, because the cleaning unit that removes residual heatset ink remained on the surface of the blanket cylinder is provided, the next printing is not affected by the ink remained on the blanket cylinder, so that it is possible to enhance the printing quality.

Furthermore, with the printing method according to the present invention, either the rotating blanket cylinder or the printing medium conveyed into the contact portion of the blanket cylinder and the printing cylinder is heated, an image is formed on the surface of the blanket cylinder by squirting the heatset ink onto the surface of the blanket cylinder, the image formed on the blanket cylinder is transferred onto the printing medium at the contact portion of the blanket cylinder and the printing cylinder, and the image transferred onto the printing medium is dried by heating the image. Therefore, the ink does not penetrate into the printing medium, so that the printing accuracy can be enhanced, and furthermore, it is possible to suppress the increase of cost without using expensive ink.

With the printing method according to the present invention, because the image transferred onto the printing medium is dried by being heated, it is possible to dry the ink at an early stage.

The sheet-fed printing press according to the present invention is constituted by the feeder device, the printing device, and the delivery device, and the printing device includes the inkjet head that forms an image on the surface of the blanket cylinder by squirting the heatset ink onto the surface of the blanket cylinder and the first heating unit that heats up either the printing medium conveyed into the contact portion of the printing cylinder and the blanket cylinder or the blanket cylinder. Therefore, because the printing medium or the blanket cylinder is heated in advance by the first heating unit, the heatset ink of the image formed on the surface of the blanket cylinder by the inkjet head is dried on the printing medium or the blanket cylinder, so that the printing accuracy can be enhanced without the ink being penetrated into the printing medium, and furthermore, it is possible to suppress the increase of cost without using expensive ink.

The rotary printing press according to the present invention is constituted by the feeder device, the printing device, the drying device, the folding device, and the delivery device, and the printing device includes the inkjet head that forms an image on the surface of the blanket cylinder by squirting the heatset ink onto the surface of the blanket cylinder and the first heating unit that heats up either the printing medium conveyed into the contact portion of the printing cylinder and the blanket cylinder or the blanket cylinder. Therefore, because the printing medium or the blanket cylinder is heated in advance by the first heating unit, the heatset ink of the image formed on the surface of the blanket cylinder by the inkjet head is dried on the printing medium or the blanket cylinder, so that the printing accuracy can be enhanced without the ink being penetrated into the printing medium, and furthermore, it is possible to suppress the increase of cost without using expensive ink.

DESCRIPTION OF EMBODIMENTS

Exemplary embodiments of a printing device, a printing method, a sheet-fed printing press, and a rotary printing press according to the present invention will be explained below in detail with reference to the accompanying drawings. The present invention is not limited to the embodiments.

First Embodiment

Figure 1:
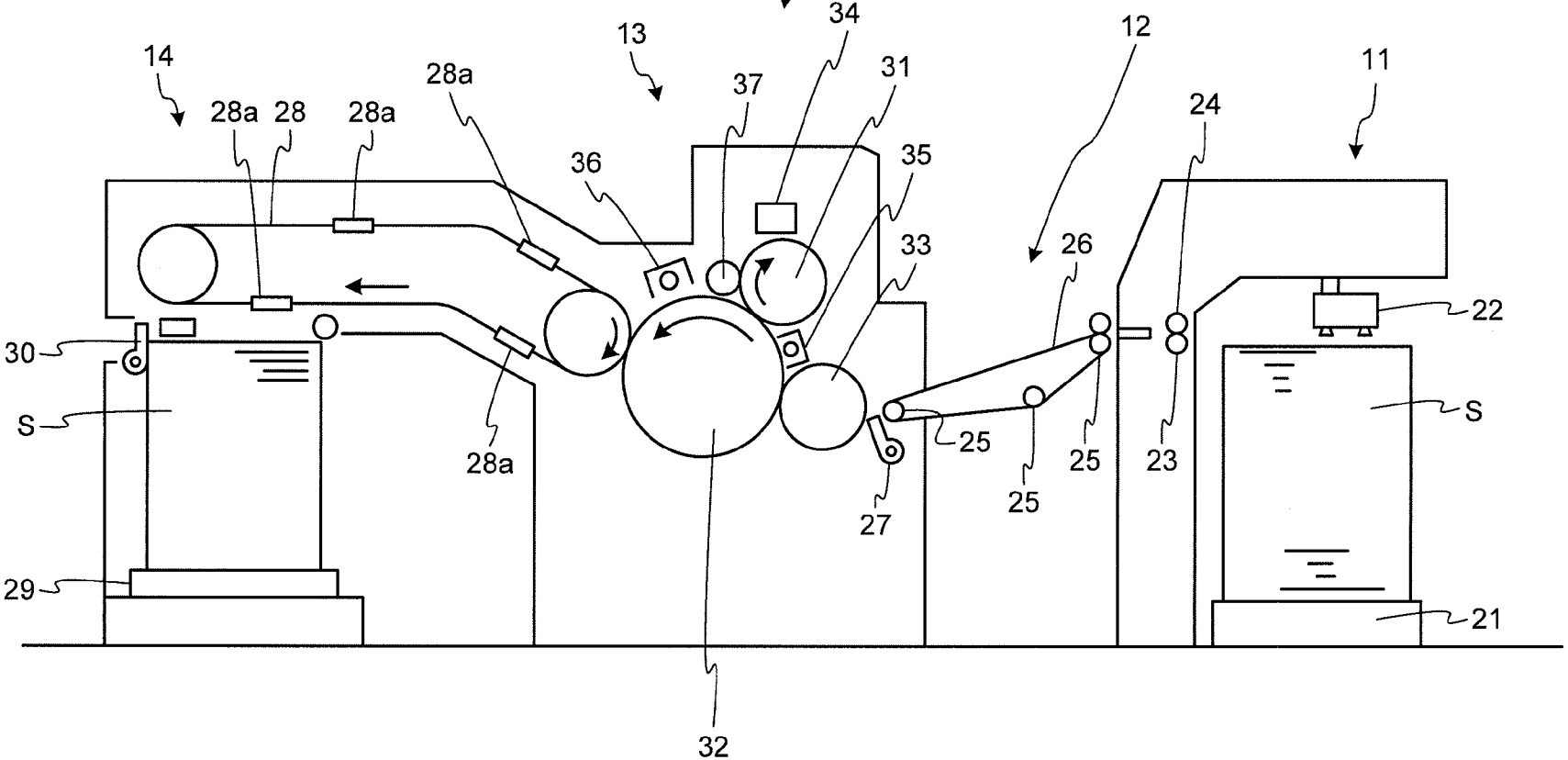
FIG. 1 is a schematic configuration diagram of a sheet-fed printing press including a printing device according to a first embodiment of the present invention.
Figure 2:
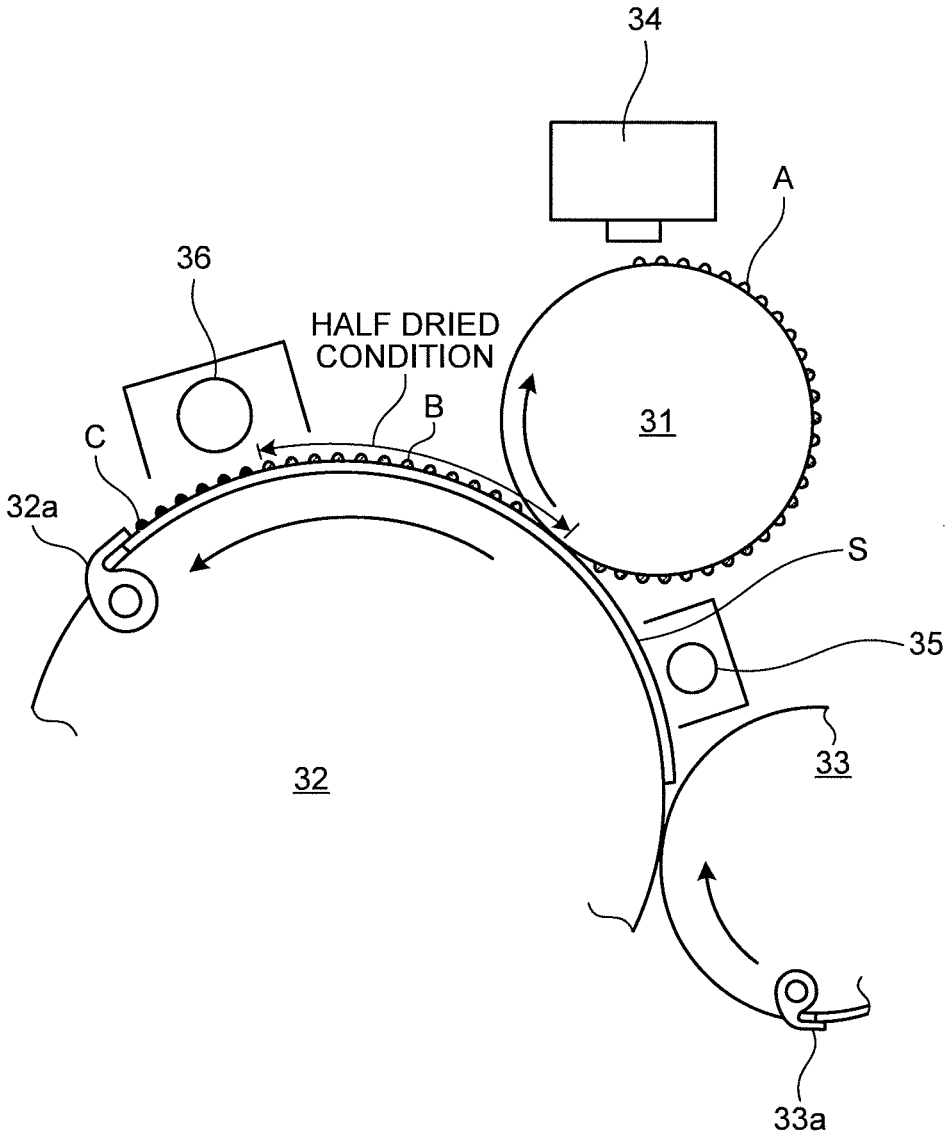
FIG. 2 is a schematic diagram of relevant parts of the printing device according to the first embodiment.

FIG. 1 is a schematic configuration diagram of a sheet-fed printing press including a printing device according to a first embodiment of the present invention, and FIG. 2 is a schematic diagram of relevant parts of the printing device according to the first embodiment.

As shown in FIG. 1, the offset sheet-fed printing press according to the first embodiment is constituted by a feeder device 11, a conveying device 12, a printing device 13, and a delivery device 14. In the present embodiment, a printing sheet (printing medium) S that is sheet paper to be placed on the feeder device 11 in a stacked manner is the one on which a portion except for a predetermined area is printed at a multicolor sheet-fed printing press that is not shown in the figure, so that the printing is performed on the predetermined white area by the printing device 13. The multicolor sheet-fed printing press includes, for example, four printing units corresponding to four colors of Bk (Black), C (Cyan), M (Magenta), and Y (Yellow). Each of the printing units has virtually the same configuration, including an inking system, a plate cylinder, a blanket cylinder, and an impression cylinder, and the printing is performed when the printing sheet S passes between the blanket cylinder and the impression cylinder by ink (printing image) being transferred from the blanket cylinder onto the printing sheet S.

The feeder device 11 includes a feeder pile board 21 and a separator unit 22 as a feeding mechanism. The printing sheet S is placed on the feeder pile board 21 in a stacked manner, and the separator unit 22 takes and sends a plurality of printing sheets S stacked on the feeder pile board 21 one by one from the top of the stack. In this case, the feeder pile board 21 is configured to position in the up-and-down direction according to feeding of the printing sheets S such that the separator unit 22 can keep a positional relation with the printing sheets S at a substantially constant height.

The conveying device 12 conveys the printing sheet S sent from the feeder device 11 to a predetermined position and supplies it to the printing device 13. In the conveying device 12, a feed roller 23 and a grip roller 24 are arranged to make contact with each other in the up-and-down direction near the feeder device 11, a conveying belt 26 supported by a plurality of guide rollers 25 is arranged, and a front lay 27 is arranged near the printing device 13.

In the printing device 13, a blanket cylinder 31 and an impression cylinder (printing cylinder) 32 are supported in a rotatable manner making contact with each other in the up-and-down direction, and a transfer cylinder 33 is supported in a rotatable manner making contact with the impression cylinder 32 near the front lay 27. The blanket cylinder 31, the impression cylinder 32, and the transfer cylinder 33 are connected by gear in such a manner that they make a synchronous rotation along directions indicated by arrows, being configured to rotate by a motor that is not shown in the figure. In this case, a blanket formed of silicon is wound around a surface of the blanket cylinder 31 considering separation of the image. The impression cylinder 32 and the transfer cylinder 33 include gripper nails 32*a* and 33*a* (see FIG. 2), respectively. The gripper nail 33*a* of the transfer cylinder 33 grips a leading edge (front edge in the conveying direction) of the printing sheet S that is positioned by the front lay 27 of the conveying device 12 and conveys it, and the gripper nail 32*a* of the impression cylinder 32 grips the leading edge of the printing sheet S that is released from the gripper nail 33*a* of the transfer cylinder 33 and conveys it.

On the outer periphery of the blanket cylinder 31, an inkjet head 34 is provided, which forms an image on the surface of the blanket cylinder 31 by squirting heatset ink (hereinafter, "water-based ink or oil-based ink containing ink thermal curing ink thermal curing resin"). The inkjet head 34 includes a plurality of nozzles (not shown) arranged along the axial direction of the blanket cylinder 31, so that it can squirt the heatset ink onto the whole area of the printing sheet S in the width direction.

On the outer periphery of the impression cylinder 32, a preheating lamp 35 is provided, being located on the upstream side of the rotation direction of the impression cylinder 32 from a contact position of the impression cylinder 32 and the blanket cylinder 31 and serving as a first heating unit that heats up a printing surface of the printing sheet S conveyed by the impression cylinder 32. Moreover, on the outer periphery of the impression cylinder 32, a heating lamp 36 is provided, being located on the downstream side of the rotation direction of the impression cylinder 32 from the contact position of the impression cylinder 32 and the blanket cylinder 31 and serving as a second heating unit that heats up the image (heatset ink) transferred onto the printing surface of the printing sheet S from the blanket cylinder 31. In this case, each of the preheating lamp 35 and the heating lamp 36 is either a halogen lamp or an infrared lamp, and an output of the preheating lamp 35 is set to 10% to 30% and an output of the heating lamp 36 is set to 70% to 90% with respect to an output for fully drying the image of the heatset ink squirted from the inkjet head 34.

On the outer periphery of the blanket cylinder 31, a cleaning roller 37 is provided, being located on the downstream side of the rotation direction of the blanket cylinder 31 from the contact position with the impression cylinder 32 and on the upstream side of the rotation direction of the blanket cylinder 31 from the inkjet head 34 and serving as a cleaning unit that cleans the blanket cylinder 31 by removing residual ink remained on the surface of the blanket cylinder 31 after the image formed on the surface of the blanket cylinder 31 is transferred onto the printing sheet S. The cleaning roller 37 removes the heatset ink remained on the surface of the blanket cylinder 31 by rotating with the blanket cylinder 31 or being driven to rotate in the opposite direction.

The delivery device 14 conveys the printing sheet S on which the image is printed at the printing device 13 and stacks printing sheets S in the up-and-down direction in an aligned state. The delivery device 14 includes a chain gripper 28 that conveys the printing sheet S, a delivery pile board 29 on which the printing sheets S on which the image is printed are stacked, and a paper stopper 30 that aligns the printing sheet S. The chain gripper 28 includes a plurality of gripper nails 28*a* for gripping the leading edge of the printing sheet S, and receives the printing sheet S from the impression cylinder 32 of the printing device 13 and conveys it to a predetermined position at an up-and-down position of the delivery pile board 29. The delivery pile board 29 is configured to move down continuously or in a stepwise manner such that a drop distance of the printing sheet S is kept substantially constant when the height of an upper surface of the top of the printing sheets S is raised with stacking of the printing sheets S. The paper stopper 30 determines a leading edge position of the printing sheet S in the conveying direction.

A printing method using the offset sheet-fed printing press according to the first embodiment with the above configuration is explained below.

First, the printing sheets S stacked on the feeder pile board 21 of the feeder device 11 are taken one by one from the top by the separator unit 22 and sent to the conveying device 12, and then the conveying device 12 positions the printing sheets S with the front lay 27 and sequentially supplies them to the printing device 13.

Subsequently, in the printing device 13, the inkjet head 34 forms a predetermined image on the surface of the blanket cylinder 31 by squirting the heatset ink from the nozzles onto the blanket cylinder 31. The transfer cylinder 33 receives the printing sheet S sent from the conveying device 12, delivers it to the impression cylinder 32, and preheats the printing surface by the heat from the preheating lamp 35 before the printing sheet S is conveyed by the impression cylinder 32 to the contact position with the blanket cylinder 31.

When the printing sheet S is then conveyed to the impression cylinder 32 and reaches the contact position with the blanket cylinder 31, the image of the blanket cylinder 31 is transferred onto the printing sheet S while the printing sheet S passes between the cylinders 31 and 32 with the cylinders 31 and 32 being pressed. At this time, the image (heatset ink) transferred onto the printing sheet S is subject to a primary dry, i.e., half dried, because the heat is applied from the printing sheet S that is in a high-temperature condition. Thereafter, the image moved with the rotation of the impression cylinder 32 is subject to a secondary dry, i.e., fully dried, by the heat from the heating lamp 36.

The heatset ink remained on the surface of the blanket cylinder 31 from which the image on the surface is transferred onto the printing sheet S is removed by making contact with the cleaning roller 37.

Processes of drying and generating the image (heatset ink) described above are explained below in detail. As shown in FIG. 2, the heatset ink is squirted from the inkjet head 34 onto the surface of the blanket cylinder 31, and the heatset ink (reverse) A of the image formed on the surface of the blanket cylinder 31 becomes in a low-viscosity condition. The heatset ink A of the image in the low-viscosity condition moved by the rotation of the blanket cylinder 31 is transferred onto the surface of the printing sheet S by a predetermined nip operating with the printing sheet S conveyed by the blanket cylinder 31 and the impression cylinder 32. At this time, the heatset ink A of the image in the low-viscosity condition becomes heatset ink B (a hatched line) in a half dried condition by the heat applied from the printing sheet S heated by the preheating lamp 35. When the printing sheet S is moved by the rotation of the impression cylinder 32, the heatset ink B of the image in the half dried condition moved with the printing sheet S becomes heatset ink (black) C in a fully dried condition by the heat from the heating lamp 36.

Thereafter, the printing sheet S on which the image is printed at the printing device 13 is sent to the delivery device 14 from the printing device 13, and the chain gripper 28 conveys the printing sheet S while gripping the leading edge of the printing sheet S and stacks it on the delivery pile board 29.

In this manner, the offset sheet-fed printing press according to the first embodiment includes the rotatable impression cylinder 32, the blanket cylinder 31 that is configured to make a synchronous rotation with the impression cylinder 32 in contact with each other and to convey the printing sheet S by nipping the printing sheet S with the impression cylinder 32, the inkjet head 34 that forms an image on the surface of the blanket cylinder 31 by squirting the heatset ink onto the surface of the blanket cylinder 31, the preheating lamp 35 that heats up the printing sheet S to be conveyed to the contact position of the blanket cylinder 31 and the impression cylinder 32, and the heating lamp 36 that heats up the image transferred onto the printing sheet S from the blanket cylinder 31.

Therefore, by preheating the printing sheet S in advance by the preheating lamp 35, the heatset ink of the image formed on the surface of the blanket cylinder 31 by the inkjet head 34 is primarily dried when it is transferred onto the printing sheet S, and thereafter, it is secondarily dried by the heating lamp 36, by which the ink does not penetrate into the printing sheet S so that the printing accuracy can be enhanced, and furthermore, it is possible to suppress the increase of cost without using expensive UV curing ink.

Furthermore, in the offset sheet-fed printing press according to the first embodiment, the preheating lamp 35 is used as the first heating unit, which heats up the printing surface of the printing sheet S before the image is transferred from the blanket cylinder 31. Therefore, when the image is transferred onto the printing surface of the printing sheet S from the blanket cylinder 31, the heatset ink forming the image receives the heat from the printing sheet S, by which it is primarily dried, so that it is possible to dry the ink at an early stage.

Moreover, the offset sheet-fed printing press according to the first embodiment includes the cleaning roller 37 that removes the ink remained on the surface of the blanket cylinder 31 after the image formed on the surface of the blanket cylinder 31 is transferred onto the printing sheet S. Therefore, because the ink remained on the blanket cylinder 31 is removed for every printing, the next printing is not affected by the ink remained on the blanket cylinder 31, so that it is possible to enhance the printing quality.

Second Embodiment

Figure 3:
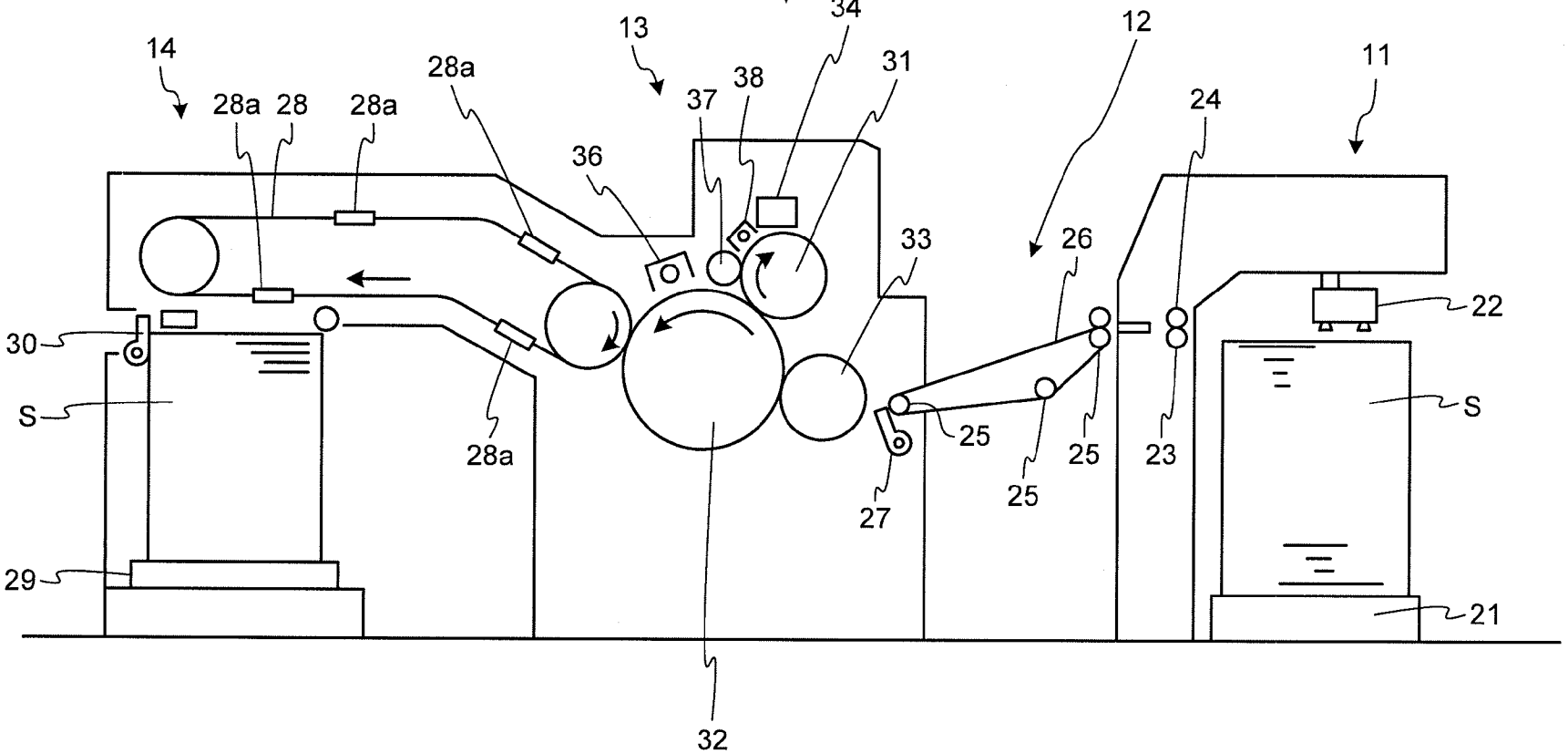
FIG. 3 is a schematic configuration diagram of a sheet-fed printing press including a printing device according to a second embodiment of the present invention.
Figure 4:
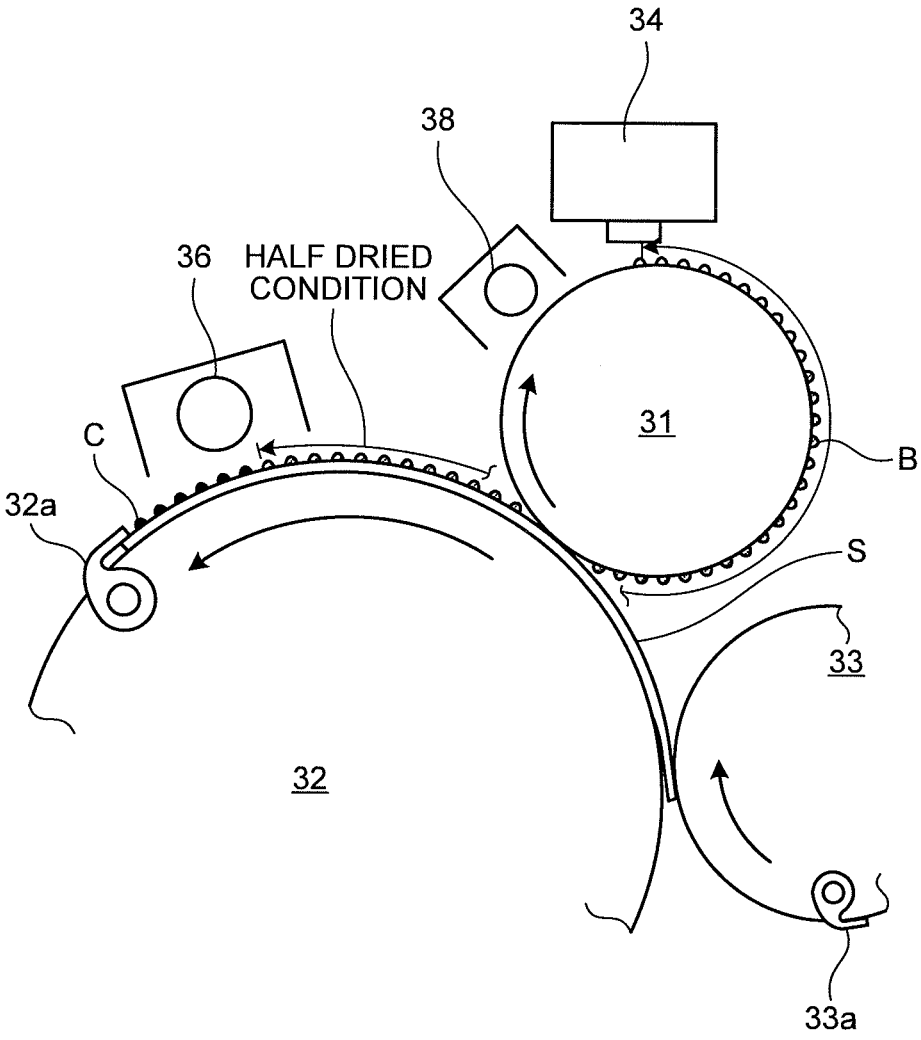
FIG. 4 is a schematic diagram of relevant parts of the printing device according to the second embodiment.

FIG. 3 is a schematic configuration diagram of a sheet-fed printing press including a printing device according to a second embodiment of the present invention, and FIG. 4 is a schematic diagram of relevant parts of the printing device according to the second embodiment. Elements having the same functions as those described in the above embodiment are denoted by like reference signs and redundant explanations thereof will be omitted.

As shown in FIG. 3, the offset sheet-fed printing press according to the second embodiment is constituted by the feeder device 11, the conveying device 12, the printing device 13, and the delivery device 14. The feeder device 11, the conveying device 12, and the delivery device 14 have the same configurations as those of the first embodiment, and only the configuration of the printing device 13 is different.

That is, in the printing device 13, on the outer periphery of the blanket cylinder 31, the inkjet head 34 is provided, which forms an image on a surface of the blanket cylinder 31 by squirting heatset ink. Furthermore, on the outer periphery of the blanket cylinder 31, a preheating lamp 38 is provided, being located on the upstream side of the rotation direction of the blanket cylinder 31 from the inkjet head 34 and serving as a first heating unit that heats up the surface of the blanket cylinder 31. Moreover, on the outer periphery of the impression cylinder 32, the heating lamp 36 is provided, being located on the downstream side of the rotation direction of the impression cylinder 32 from a contact position of the impression cylinder 32 and the blanket cylinder 31 and serving as a second heating unit that heats up the image (heatset ink) transferred onto the printing surface of a printing sheet S from the blanket cylinder 31. In this case, each of the preheating lamp 38 and the heating lamp 36 is either a halogen lamp or an infrared lamp, and an output of the preheating lamp 38 is set to 10% to 30% and an output of the heating lamp 36 is set to 70% to 90% with respect to an output for fully drying the image of the heatset ink squirted from the inkjet head 34.

In addition, on the outer periphery of the blanket cylinder 31, the cleaning roller 37 is provided, being located on the downstream side of the rotation direction of the blanket cylinder 31 from the contact position with the impression cylinder 32 and on the upstream side of the rotation direction of the blanket cylinder 31 from the preheating lamp 38 after the image formed on the surface of the blanket cylinder 31 is transferred onto the printing sheet S.

A printing method using the offset sheet-fed printing press according to the second embodiment with the above configuration is explained below.

First, the printing sheets S stacked on a feeder pile board 21 of the feeder device 11 are taken one by one from the top by a separator unit 22 and sent to the conveying device 12, and then the conveying device 12 positions the printing sheets S with a front lay 27 and sequentially supplies them to the printing device 13.

Subsequently, in the printing device 13, after the blanket cylinder 31 is heated by the heat from the preheating lamp 38, the inkjet head 34 forms a predetermined image on the surface of the blanket cylinder 31 by squirting the heatset ink from a plurality of nozzles onto the blanket cylinder 31. At this time, specifically, during the heatset ink is transferred onto the printing sheet S since it adheres to the blanket cylinder 31, the image (heatset ink) formed on the blanket cylinder 31 is subject to a primary dry, i.e., half dried, because the heat is applied from the blanket cylinder 31 that is in a high-temperature condition.

Meanwhile, the transfer cylinder 33 receives the printing sheet S sent from the conveying device 12, delivers it to the impression cylinder 32, and the printing sheet S is conveyed by the impression cylinder 32 to a contact position with the blanket cylinder 31. When the printing sheet S is conveyed to the impression cylinder 32 and reaches the contact position of the blanket cylinder 31 and the impression cylinder 32, the image of the blanket cylinder 31 is transferred onto the printing sheet S while the printing sheet S passes between the cylinders 31 and 32 with the cylinders 31 and 32 being pressed. Thereafter, the image moved with the rotation of the impression cylinder 32 is subject to a secondary dry, i.e., fully dried, by the heat from the heating lamp 36.

Processes of drying and generating the image (heatset ink) described above are explained below in detail. As shown in FIG. 4, the heatset ink (reverse) squirted from the inkjet head 34 onto the surface of the blanket cylinder 31 is in a low-viscosity condition. However, because the blanket cylinder 31 is heated by the preheating lamp 38, when the heatset ink in the low-viscosity condition adheres to the surface of the blanket cylinder 31 to form the image, the viscosity of the heatset ink is increased, and it becomes heatset ink B (a hatched line) in a half dried condition. The heatset ink B in the half dried condition moved by the rotation of the blanket cylinder 31 is transferred onto the surface of the printing sheet S by a predetermined nip operating with the printing sheet S conveyed by the blanket cylinder 31 and the impression cylinder 32. Thereafter, when the printing sheet S is moved by the rotation of the impression cylinder 32, the heatset ink B of the image in the half dried condition moved with the printing sheet S becomes heatset ink (black) C in a fully dried condition by the heat from the heating lamp 36.

In this manner, the offset sheet-fed printing press according to the second embodiment includes the rotatable impression cylinder 32, the blanket cylinder 31 that is configured to make a synchronous rotation with the impression cylinder 32 in contact with each other and to convey the printing sheet S by nipping the printing sheet S with the impression cylinder 32, the inkjet head 34 that forms an image on the surface of the blanket cylinder 31 by squirting the heatset ink onto the surface of the blanket cylinder 31, the preheating lamp 38 that heats up the blanket cylinder 31, and the heating lamp 36 that heats up the image transferred onto the printing sheet S from the blanket cylinder 31.

Therefore, by preheating the blanket cylinder 31 in advance by the preheating lamp 38, the heatset ink of the image formed on the surface of the blanket cylinder 31 by the inkjet head 34 is primarily dried, and thereafter, it is secondarily dried by the heating lamp 36, by which the ink does not penetrate into the printing sheet S so that the printing accuracy can be enhanced, and furthermore, it is possible to suppress the increase of cost without using expensive UV curing ink.

Furthermore, in the offset sheet-fed printing press according to the second embodiment, the preheating lamp 38 is used as the first heating unit, which heats up the surface of the blanket cylinder 31 before the heatset ink is squirted from the inkjet head 34. Therefore, when the heatset ink is squirted onto the surface of the blanket cylinder 31, the image is primarily dried, so that it is possible to dry the ink at an early stage.

Third Embodiment

Figure 5:
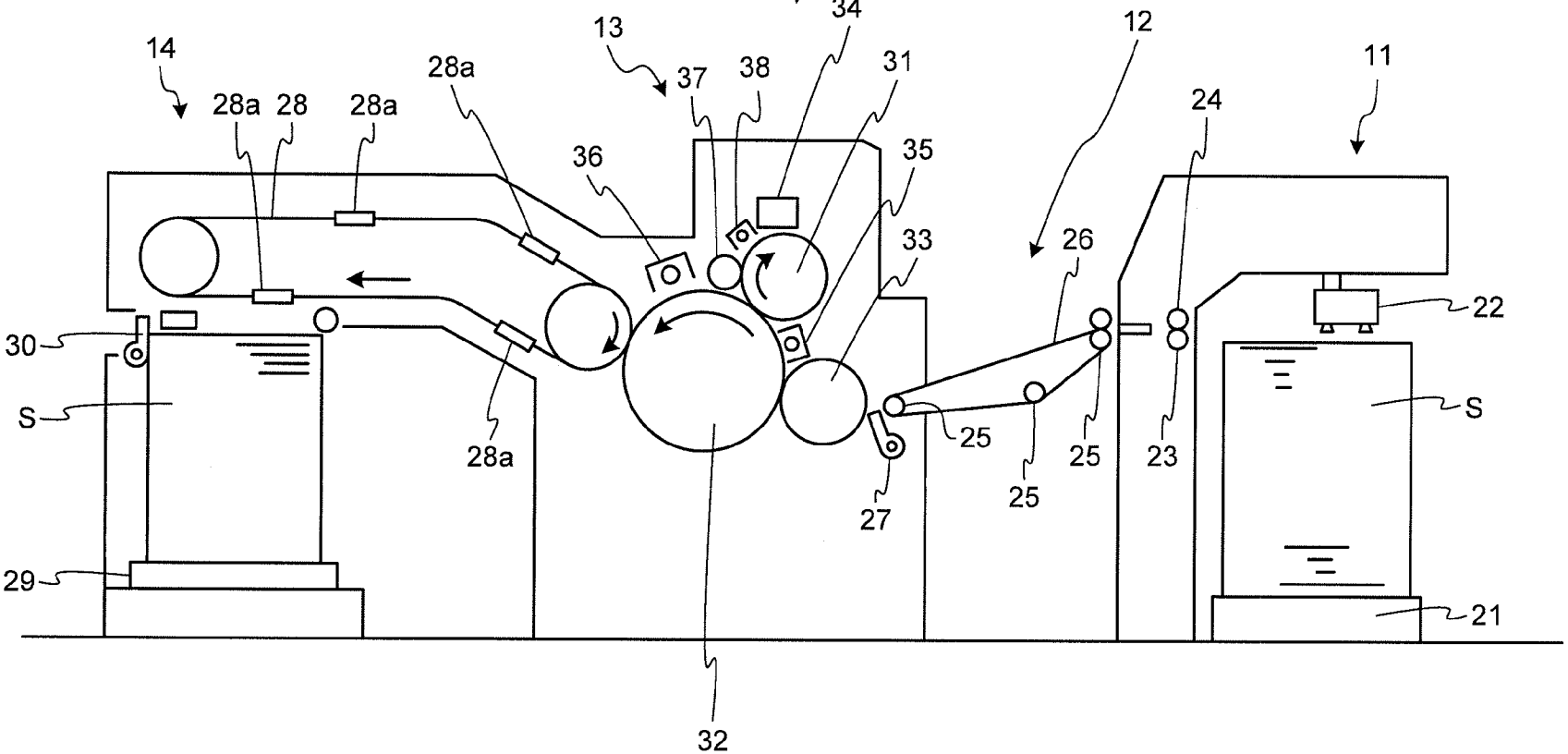
FIG. 5 is a schematic configuration diagram of a sheet-fed printing press including a printing device according to a third embodiment of the present invention.

FIG. 5 is a schematic configuration diagram of a sheet-fed printing press including a printing device according to a third embodiment of the present invention. Elements having the same functions as those described in the above embodiments are denoted by like reference signs and redundant explanations thereof will be omitted.

As shown in FIG. 5, the offset sheet-fed printing press according to the third embodiment is constituted by the feeder device 11, the conveying device 12, the printing device 13, and the delivery device 14. The feeder device 11, the conveying device 12, and the delivery device 14 have the same configurations as those of the first embodiment, and only the configuration of the printing device 13 is different. Specifically, the printing device 13 has a configuration obtained by combining those of the first embodiment and the second embodiment.

That is, in the printing device 13, on the outer periphery of the blanket cylinder 31, the inkjet head 34 is provided, which forms an image on a surface of the blanket cylinder 31 by squirting heatset ink. On the outer periphery of the impression cylinder 32, a first preheating lamp 35 is provided, being located on the upstream side of the rotation direction of the impression cylinder 32 from a contact position of the impression cylinder 32 and the blanket cylinder 31 and serving as a first heating unit that heats up a printing surface of the printing sheet S conveyed by the impression cylinder 32. Furthermore, on the outer periphery of the blanket cylinder 31, a second preheating lamp 38 is provided, being located on the upstream side of the rotation direction of the blanket cylinder 31 from the inkjet head 34 and serving as a first heating unit that heats up the surface of the blanket cylinder 31. Moreover, on the outer periphery of the impression cylinder 32, the heating lamp 36 is provided, being located on the downstream side of the rotation direction of the impression cylinder 32 from a contact position of the impression cylinder 32 and the blanket cylinder 31 and serving as a second heating unit that heats up the image (heatset ink) transferred onto the printing surface of a printing sheet S from the blanket cylinder 31. In this case, each of the lamps 35, 36, and 38 is either a halogen lamp or an infrared lamp, and an output of each of the preheating lamps 35 and 38 is set to 10% to 30% and an output of the heating lamp 36 is set to 70% to 90% with respect to an output for fully drying the image of the heatset ink squirted from the inkjet head 34.

Therefore, in the printing device 13, after the surface of the blanket cylinder 31 is heated by the heat from the preheating lamp 38, the inkjet head 34 forms a predetermined image on the surface of the heated blanket cylinder 31 by squirting the heatset ink from a plurality of nozzles onto the blanket cylinder 31. While the heatset ink is transferred onto the printing sheet S since it adheres to the blanket cylinder 31, the image (heatset ink) formed on the blanket cylinder 31 is dried because the heat is applied from the blanket cylinder 31 that is in the high-temperature condition.

Meanwhile, the transfer cylinder 33 receives the printing sheet S sent from the conveying device 12, delivers it to the impression cylinder 32, and the printing surface of the printing sheet S is preheated by the heat from the preheating lamp 35 before the printing sheet S is conveyed by the impression cylinder 32 to a contact position with the blanket cylinder 31. When the printing sheet S is conveyed to the impression cylinder 32 and reaches the contact position of the blanket cylinder 31 and the impression cylinder 32, the image of the blanket cylinder 31 is transferred onto the printing sheet S while the printing sheet S passes between the cylinders 31 and 32 with the cylinders 31 and 32 being pressed. At this time, the image (heatset ink) transferred onto the printing sheet S is dried by the heat applied from the printing sheet S in the high-temperature condition. In this case, the image (heatset ink) on the printing sheet S is subject to a primary dry, i.e., half dried, by the heat from the blanket cylinder 31 and the heat from the printing sheet S, so that it is possible to achieve a more ideal half dry condition by adjusting amounts of the heats. Thereafter, the image moved with the rotation of the impression cylinder 32 is subject to a secondary dry, i.e., fully dried, by the heat from the heating lamp 36.

In this manner, the offset sheet-fed printing press according to the second embodiment includes the rotatable impression cylinder 32, the blanket cylinder 31 that is configured to make a synchronous rotation with the impression cylinder 32 in contact with each other and to convey the printing sheet S by nipping the printing sheet S with the impression cylinder 32, the inkjet head 34 that forms an image on the surface of the blanket cylinder 31 by squirting the heatset ink onto the surface of the blanket cylinder 31, the preheating lamp 35 that heats up the printing sheet S to be conveyed to the contact position of the blanket cylinder 31 and the impression cylinder 32, the preheating lamp 38 that heats up the blanket cylinder 31, and the heating lamp 36 that heats up the image transferred onto the printing sheet S from the blanket cylinder 31.

Therefore, by preheating the blanket cylinder 31 in advance by the preheating lamp 38, the heatset ink of the image formed on the surface of the blanket cylinder 31 by the inkjet head 34 is primarily dried, and the heatset ink of the image formed on the surface of the blanket cylinder 31 is further primarily dried when it is transferred onto the printing sheet S, and thereafter it is secondarily dried by the heating lamp 36, by which the ink does not penetrate into the printing sheet S so that the printing accuracy can be enhanced, and furthermore, it is possible to suppress the increase of cost without using expensive UV curing ink.

Furthermore, in this case, it is possible to achieve enough primary dry by arranging two preheating lamps 35 and 38 for the primary dry (half dry), so that the separation of the ink from the blanket cylinder 31 can be enhanced, and at the same time, the adherence (transferability) of the ink to the printing sheet S can be enhanced, so that it is possible to enhance the printing accuracy.

Fourth Embodiment

Figure 6:
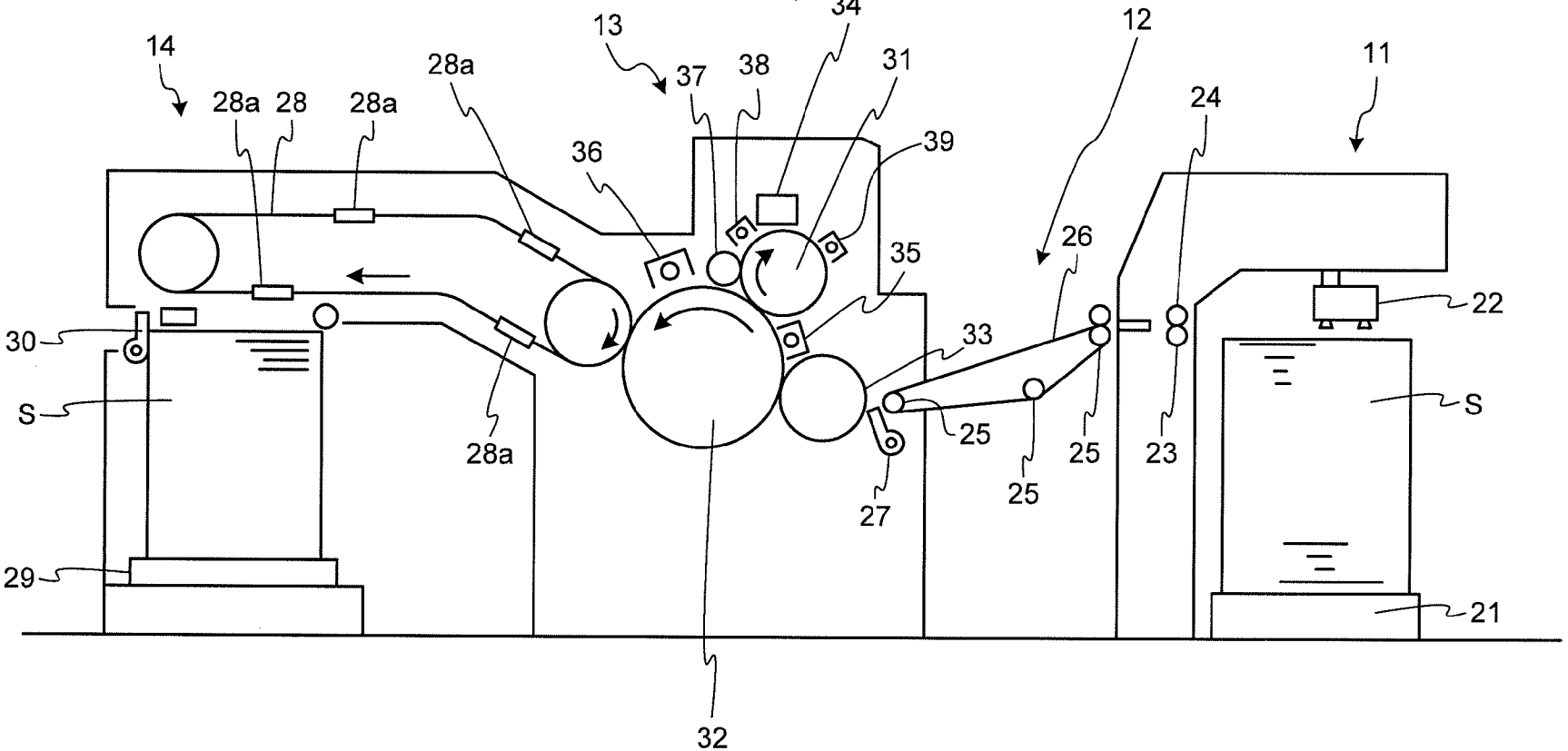
FIG. 6 is a schematic configuration diagram of a sheet-fed printing press including a printing device according to a fourth embodiment of the present invention.

FIG. 6 is a schematic configuration diagram of a sheet-fed printing press including a printing device according to a fourth embodiment of the present invention. Elements having the same functions as those described in the above embodiments are denoted by like reference signs and redundant explanations thereof will be omitted.

As shown in FIG. 6, the offset sheet-fed printing press according to the fourth embodiment is constituted by the feeder device 11, the conveying device 12, the printing device 13, and the delivery device 14. The feeder device 11, the conveying device 12, and the delivery device 14 have the same configurations as those of the first embodiment, and only the configuration of the printing device 13 is different.

That is, in the printing device 13, on the outer periphery of the blanket cylinder 31, the inkjet head 34 is provided. On the outer periphery of the impression cylinder 32, the first preheating lamp 35 is provided, being located on the upstream side of the rotation direction of the impression cylinder 32 from a contact position of the impression cylinder 32 and the blanket cylinder 31. Furthermore, on the outer periphery of the blanket cylinder 31, the second preheating lamp 38 is provided, being located on the upstream side of the rotation direction of the blanket cylinder 31 from the inkjet head 34. Moreover, on the outer periphery of the blanket cylinder 31, a first heating lamp 39 is provided, being located on the downstream side of the rotation direction of the blanket cylinder 31 from the inkjet head 34 and serving as a first heating unit that heats up the image (heatset ink) formed on the blanket cylinder 31. On the outer periphery of the impression cylinder 32, a second heating lamp 36 is provided, being located on the downstream side of the rotation direction of the impression cylinder 32 from a contact position of the impression cylinder 32 and the blanket cylinder 31.

Therefore, in the printing device 13, after the surface of the blanket cylinder 31 is heated by the heat from the preheating lamp 38, the inkjet head 34 forms a predetermined image on the surface of the heated blanket cylinder 31 by squirting the heatset ink from a plurality of nozzles onto the blanket cylinder 31. While the heatset ink is transferred onto the printing sheet S since it adheres to the blanket cylinder 31, the image (heatset ink) formed on the blanket cylinder 31 is dried because the heat is applied from the blanket cylinder 31 that is in the high-temperature condition. Furthermore, the image (heatset ink) formed on the blanket cylinder 31 is dried by the heat from the first heating lamp 39.

Meanwhile, the transfer cylinder 33 receives the printing sheet S sent from the conveying device 12, delivers it to the impression cylinder 32, and the printing surface of the printing sheet S is preheated by the heat from the preheating lamp 35 before the printing sheet S is conveyed by the impression cylinder 32 to a contact position with the blanket cylinder 31. When the printing sheet S is conveyed to the impression cylinder 32 and reaches the contact position of the blanket cylinder 31 and the impression cylinder 32, the image of the blanket cylinder 31 is transferred onto the printing sheet S while the printing sheet S passes between the cylinders 31 and 32 with the cylinders 31 and 32 being pressed. At this time, the image (heatset ink) transferred onto the printing sheet S is dried by the heat applied from the printing sheet S in the high-temperature condition. In this case, the image (heatset ink) on the printing sheet S is subject to a primary dry, i.e., half dried, by the heat from the blanket cylinder 31, the heat from the first heating lamp 39, and the heat from the printing sheet S, so that it is possible to achieve a more ideal half dry condition by adjusting amounts of the heats. Thereafter, the image moved with the rotation of the impression cylinder 32 is subject to a secondary dry, i.e., fully dried, by the heat from the heating lamp 36.

In this case, the back side of the image (heatset ink) formed on the surface of the blanket cylinder 31 is dried by the surface of the blanket cylinder 31 that is in the high-temperature condition, and the front side of the image is dried by the heat from the first heating lamp 39. The image is then transferred onto the printing sheet S in such a manner that the dried front side adheres to the printing surface of the printing sheet S that is in the high-temperature condition. Therefore, the image (heatset ink) of which the front side and the back side are dried becomes easily separated from the surface of the blanket cylinder 31 and easily adheres to the printing surface of the printing sheet S.

In this manner, the offset sheet-fed printing press according to the fourth embodiment includes the first heating lamp 39 that primarily dries the image formed on the surface of the blanket cylinder 31 by the inkjet head 34 and the second heating lamp 36 that secondarily dries the image transferred from the blanket cylinder 31 onto the printing sheet S.

Therefore, because the image formed on the surface of the blanket cylinder 31 by the inkjet head 34 is transferred onto the printing sheet S after being primarily dried by the first heating lamp 39, it is transferred from the blanket cylinder 31 onto the printing sheet S in a high viscosity condition, so that the heatset ink does not penetrate into the printing sheet S, and as a result, it is possible to enhance the printing accuracy. Specifically, it is possible to enhance dot gain stability by the enhancement of the viscosity of the ink and to prevent the ink bleed, and furthermore, it is possible to suppress an influence due to the difference in paper types.

In the first to fourth embodiments, although the preheating lamp 35 or the preheating lamp 38 is provided as the first heating unit, either one of them can be provided or both of them can be provided. Furthermore, although the heating lamp 39 is provided together as the first heating unit, only the preheating lamp 35 and the heating lamp 39 can be provided or only the preheating lamp 38 and the heating lamp 39 can be provided.

Fifth Embodiment

Figure 7:
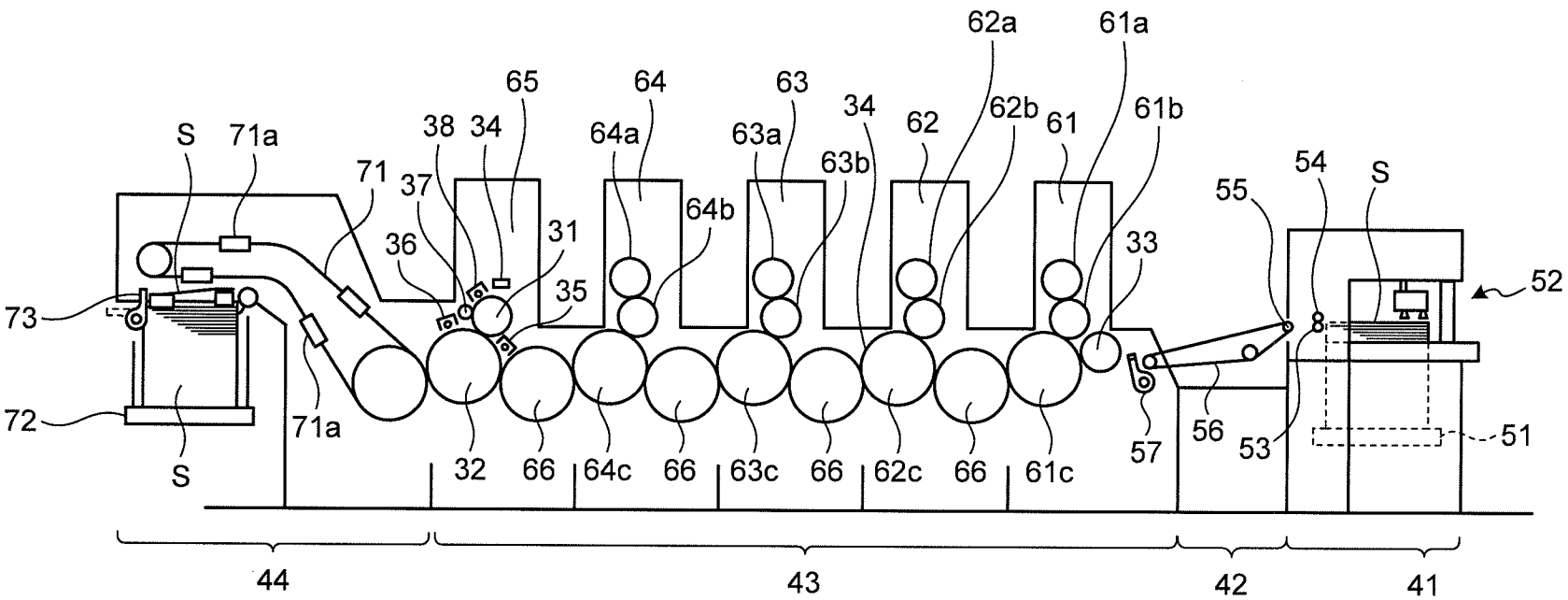
FIG. 7 is a schematic configuration diagram of a sheet-fed printing press including a printing device according to a fifth embodiment of the present invention.

FIG. 7 is a schematic configuration diagram of a sheet-fed printing press including a printing device according to a fifth embodiment of the present invention. Elements having the same functions as those described in the above embodiments are denoted by like reference signs and redundant explanations thereof will be omitted.

As shown in FIG. 7, the offset sheet-fed printing press according to the fifth embodiment is constituted by a feeder device 41, a conveying device 42, a printing device 43, and a delivery device 44.

The feeder device 41 includes a feeder pile board 51 and a separator unit 52 as a feeding mechanism. A printing sheet S is placed on the feeder pile board 51 in a stacked manner, and the separator unit 52 takes and sends a plurality of printing sheets S stacked on the feeder pile board 51 one by one from the top of the stack. In this case, the feeder pile board 51 is configured to position in the up-and-down direction according to feeding of the printing sheets S such that the separator unit 52 can keep a positional relation with the printing sheets S at a substantially constant height.

The conveying device 42 conveys the printing sheet S sent from the feeder device 41 to a predetermined position and supplies it to the printing device 43. In the conveying device 42, a feed roller 53 and a grip roller 54 are arranged to make contact with each other in the up-and-down direction near the feeder device 41, a conveying belt 56 supported by a plurality of guide rollers 55 is arranged, and a front lay 57 is arranged near the printing device 43.

The printing device 43 includes four printing units 61, 62, 63, and 64 corresponding to four colors of Bk (Black), C (Cyan), M (Magenta), and Y (Yellow) to perform color printing and a printing unit 65 that performs printing using an inkjet head (described later). The printing units 61, 62, 63, and 64 have virtually the same configuration, including an inking system (not shown), plate cylinders 61*a*, 62*a*, 63*a*, and 64*a*, blanket cylinders 61*b*, 62*b*, 63*b*, and 64*b*, and impression cylinders 61*c*, 62*c*, 63*c*, and 64*c*, respectively. The plate cylinders 61*a*, 62*a*, 63*a*, and 64*a*, the blanket cylinders 61*b*, 62*b*, 63*b*, and 64*b*, and the impression cylinders 61*c*, 62*c*, 63*c*, and 64*c* are respectively arranged from the upper side to the lower side in this order along the up-and-down direction to make contact with each other, and the ink is supplied to the blanket cylinders 61*b*, 62*b*, 63*b*, and 64*b* from the inking system via the plate cylinders 61*a*, 62*a*, 63*a*, and 64*a*, and then the ink (print image) is transferred from the blanket cylinders 61*b*, 62*b*, 63*b*, and 64*b* onto the printing sheet S when the printing sheet S passes between the blanket cylinders 61*b*, 62*b*, 63*b*, and 64*b* and the impression cylinders 61*c*, 62*c*, 63*c*, and 64*c*. A transfer cylinder 66 is provided at each position between the impression cylinders 61*c*, 62*c*, 63*c*, and 64*c*.

The printing unit 65 has virtually the same configuration as the printing device 13 explained in the third embodiment. That is, the blanket cylinder 31 and the impression cylinder 32 are supported in a rotatable manner in contact with each other in the up-an-down direction, and the transfer cylinder 66 is supported in a rotatable manner in contact with the impression cylinder 32. The impression cylinder 32 and the transfer cylinder 66 include gripper nails (not shown), respectively. The gripper nail of the transfer cylinder 66 grips the leading edge of the printing sheet S and conveys it, and the gripper nail of the impression cylinder 32 grips the leading edge of the printing sheet S that is released from the gripper nail of the transfer cylinder 66, and conveys it.

On the outer periphery of the blanket cylinder 31, the inkjet head 34 is provided, which forms an image on the surface of the blanket cylinder 31 by squirting heatset ink. On the outer periphery of the impression cylinder 32, the first preheating lamp 35 is provided, which heats up a printing surface of the printing sheet S conveyed by the impression cylinder 32. On the outer periphery of the blanket cylinder 31, the second preheating lamp 38 is provided, which heats up the surface of the blanket cylinder 31. On the outer periphery of the impression cylinder 32, the heating lamp 36 is provided, which heats up the image (heatset ink) transferred onto the printing surface of the printing sheet S from the blanket cylinder 31. In addition, on the outer periphery of the blanket cylinder 31, the cleaning roller 37 is provided, which cleans the surface of the blanket cylinder 31.

The delivery device 44 conveys the printing sheet S on which the image is printed at the printing device 43 and stacks printing sheets S in the up-and-down direction in an aligned state. The delivery device 44 includes a chain gripper 71 that conveys the printing sheet S, a delivery pile board 72 on which the printing sheets S on which the image is printed are stacked, and a paper stopper 73 that aligns the printing sheet S. The chain gripper 71 includes a plurality of gripper nails 71*a* for gripping the leading edge of the printing sheet S, and receives the printing sheet S from the impression cylinder 32 of the printing device 43 and conveys it to a predetermined position at an up-and-down position of the delivery pile board 72. The delivery pile board 72 is configured to move down continuously or in a stepwise manner such that a drop distance of the printing sheet S is kept substantially constant when the height of an upper surface of the top of the printing sheets S is raised with stacking of the printing sheets S. The paper stopper 73 determines a leading edge position of the printing sheet S in the conveying direction.

A printing method using the offset sheet-fed printing press according to the fifth embodiment with the above configuration is explained below.

First, the printing sheets S stacked on the feeder pile board 51 of the feeder device 41 are taken one by one from the top by the separator unit 52 and sent to the conveying device 42, and then the conveying device 42 positions the printing sheets S with the front lay 57 and sequentially supplies them to the printing device 43.

Subsequently, in the printing device 43, printing of four colors of Black, Cyan, Magenta, and Yellow is performed on the printing sheet S by the four printing units 61, 62, 63, and 64. At this time, each of the printing units 61, 62, 63, and 64 performs the printing in a portion except for a predetermined area, and the printing unit 65 performs printing on the predetermined white area.

That is, in the printing unit 65, the blanket cylinder 31 is heated by the heat from the preheating lamp 38, and the inkjet head 34 forms a predetermined image on the surface of the blanket cylinder 31 by squirting the heatset ink onto the blanket cylinder 31 that is in the high-temperature condition. During the heatset ink is transferred onto the printing sheet S since it adheres to the blanket cylinder 31, the image (heatset ink) formed on the blanket cylinder 31 is dried, because the heat is applied from the blanket cylinder 31.

Meanwhile, the transfer cylinder 66 delivers the printing sheet S to the impression cylinder 32, and the printing surface of the printing sheet S is preheated by the heat from the preheating lamp 35 before the printing sheet S is conveyed by the impression cylinder 32 to a contact position with the blanket cylinder 31. When the printing sheet S is conveyed to the impression cylinder 32 and reaches the contact position of the blanket cylinder 31 and the impression cylinder 32, the image of the blanket cylinder 31 is transferred onto the printing sheet S while the printing sheet S passes between the cylinders 31 and 32 with the cylinders 31 and 32 being pressed. At this time, the image (heatset ink) transferred onto the printing sheet S is dried by the heat applied from the printing sheet S in the high-temperature condition (primary dry, half dry). Thereafter, the image moved with the rotation of the impression cylinder 32 is subject to a secondary dry, i.e., fully dried, by the heat from the heating lamp 36.

The heatset ink remained on the surface of the blanket cylinder 31 from which the image on the surface is transferred onto the printing sheet S is removed by making contact with the cleaning roller 37.

Thereafter, the printing sheet S on which the image is printed at the printing device 43 is sent to the delivery device 44 from the printing device 43, and the chain gripper 71 conveys the printing sheet S while gripping the leading edge of the printing sheet S and stacks it on the delivery pile board 72.

In this manner, in the offset sheet-fed printing press according to the fifth embodiment, the printing unit 65 is arranged on the downstream side of the printing units 61, 62, 63, and 64 for four-color printing, and the printing unit 65 includes the rotatable impression cylinder 32, the blanket cylinder 31 that is configured to make a synchronous rotation with the impression cylinder 32 in contact with each other and to convey the printing sheet S by nipping the printing sheet S with the impression cylinder 32, the inkjet head 34 that forms an image on the surface of the blanket cylinder 31 by squirting the heatset ink onto the surface of the blanket cylinder 31, the preheating lamp 35 that heats up the printing sheet S to be conveyed to the contact position of the blanket cylinder 31 and the impression cylinder 32, the preheating lamp 38 that heats up the blanket cylinder 31, and the heating lamp 36 that heats up the image transferred onto the printing sheet S from the blanket cylinder 31.

Therefore, in the printing unit 65, by preheating the blanket cylinder 31 in advance by the preheating lamp 38, the heatset ink of the image formed on the surface of the blanket cylinder 31 by the inkjet head 34 is primarily dried, and the heatset ink of the image formed on the surface of the blanket cylinder 31 is further primarily dried when it is transferred onto the printing sheet S, and thereafter it is secondarily dried by the heating lamp 36, by which the ink does not penetrate into the printing sheet S so that the printing accuracy can be enhanced, and furthermore, it is possible to suppress the increase of cost without using expensive UV curing ink.

Sixth Embodiment

Figure 8:
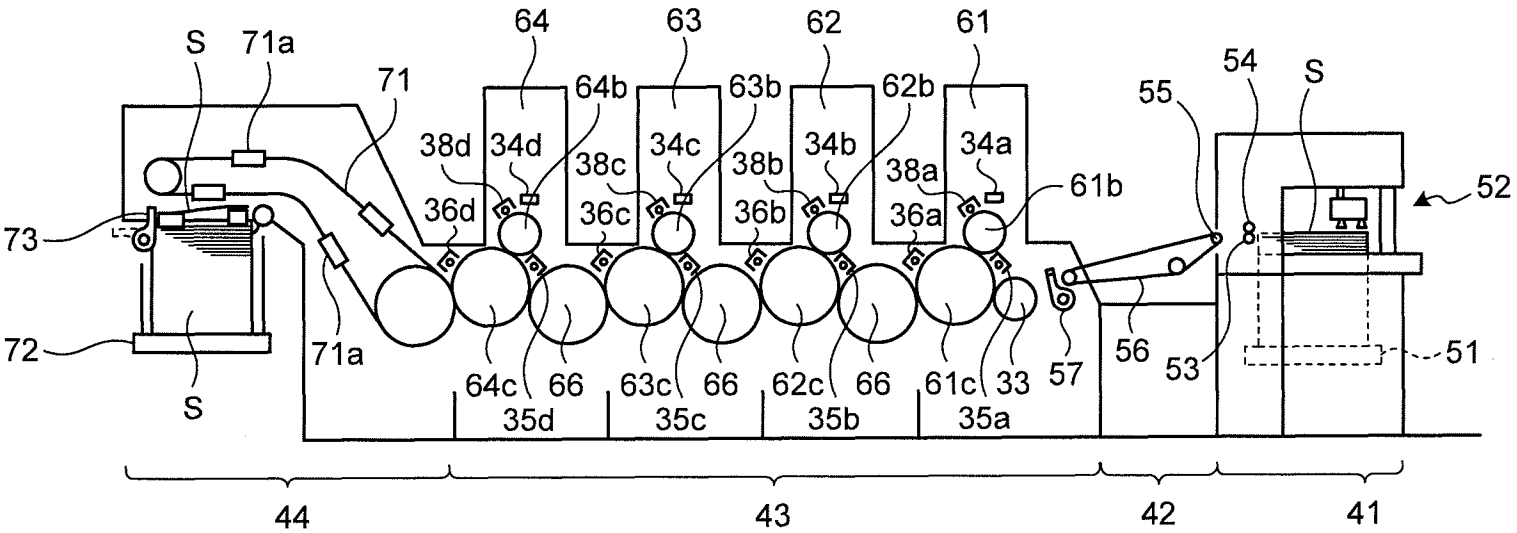
FIG. 8 is a schematic configuration diagram of a sheet-fed printing press including a printing device according to a sixth embodiment of the present invention.

FIG. 8 is a schematic configuration diagram of a sheet-fed printing press including a printing device according to a sixth embodiment of the present invention. Elements having the same functions as those described in the above embodiments are denoted by like reference signs and redundant explanations thereof will be omitted.

As shown in FIG. 8, the offset sheet-fed printing press according to the sixth embodiment is constituted by the feeder device 41, the conveying device 42, the printing device 43, and the delivery device 44. The feeder device 41, the conveying device 42, and the delivery device 44 have the same configurations as those of the fifth embodiment, and only the configuration of the printing device 43 is different.

That is, the printing device 43 includes the four printing units 61, 62, 63, and 64 corresponding to four colors of Bk (Black), C (Cyan), M (Magenta), and Y (Yellow) to perform color printing. The printing units 61, 62, 63, and 64 have virtually the same configuration and virtually the same configuration as the printing unit 65 explained in the fifth embodiment. That is, the printing units 61, 62, 63, and 64 includes blanket cylinders 61*b*, 62*b*, 63*b*, and 64*b* and impression cylinders 61*c*, 62*c*, 63*c*, and 64*c*, respectively.

On the outer peripheries of the blanket cylinders 61*b*, 62*b*, 63*b*, and 64*b*, inkjet heads 34*a*, 34*b*, 34*c*, and 34*d* corresponding to four colors are provided, respectively.

On the outer peripheries of the impression cylinders 61*c*, 62*c*, 63*c*, and 64*c*, first preheating lamps 35*a*, 35*b*, 35*c*, and 35*d* are provided, respectively. On the outer peripheries of the blanket cylinders 61*b*, 62*b*, 63*b*, and 64*b*, second preheating lamps 38*a*, 38*b*, 38*c*, and 38*d* are further provided, respectively. On the outer peripheries of the impression cylinders 61*c*, 62*c*, 63*c*, and 64*c*, heating lamps 36*a*, 36*b*, 36*c*, and 36*d* are further provided, respectively.

First, when a printing sheet S is supplied to the printing device 43 from the feeder device 41 via the conveying device 42, four-color printing of Black, Cyan, Magenta, and Yellow is performed on the printing sheet S by the four printing units 61, 62, 63, and 64 at the printing device 43.

That is, in the printing unit 61, a surface of the blanket cylinder 61*b* is preheated by the heat from the preheating lamp 38*a*, and the inkjet head 34*a* forms a predetermined image on the blanket cylinder 61*b* by squirting black heatset ink onto the blanket cylinder 61*b* that is in the high-temperature condition. During the heatset ink is transferred onto the printing sheet S since it adheres to the blanket cylinder 61*b*, the image (heatset ink) formed on the blanket cylinder 61*b* is dried, because the heat is applied from the blanket cylinder 61*b*.

Meanwhile, the transfer cylinder 33 delivers the printing sheet S to the impression cylinder 61*c*, and the printing surface of the printing sheet S is preheated by the heat from the preheating lamp 35*a* before the printing sheet S is conveyed by the impression cylinder 61*c* to a contact position with the blanket cylinder 61*b*. When the printing sheet S is conveyed to the impression cylinder 61*c* and reaches the contact position of the blanket cylinder 61*b* and the impression cylinder 61*c*, the image of the blanket cylinder 61*b* is transferred onto the printing sheet S while the printing sheet S passes between the cylinders 61*b* and 61*c* with the cylinders 61*b* and 61*c* being pressed. At this time, the image (heatset ink) transferred onto the printing sheet S is dried by the heat applied from the printing sheet S in the high-temperature condition (primary dry, half dry). Thereafter, the image moved with the rotation of the impression cylinder 61*c* is subject to a secondary dry, i.e., fully dried, by the heat from the heating lamp 36*a*, by which the Black printing is completed.

Similarly, Cyan, Magenta, and Yellow printings are performed by the rest of three printing units 62, 63, and 64. Thereafter, the printing sheet S on which the image is printed at the printing device 43 is sent to the delivery device 44 and stacked on the delivery pile board 72.

In this manner, in the offset sheet-fed printing press according to the sixth embodiment, the printing units 61, 62, 63, and 64 for four-color printing respectively include the impression cylinders 61*c*, 62*c*, 63*c*, and 64*c* and the blanket cylinders 61*b*, 62*b*, 63*b* arranged to make contact with each other, the inkjet heads 34*a*, 34*b*, 34*c*, and 34*d* that form the images on the surfaces of the blanket cylinders 61*b*, 62*b*, 63*b* by squirting the heatset ink, the preheating lamps 35*a*, 35*b*, 35*c*, and 35*d* that heat up the printing sheet S, the preheating lamps 38*a*, 38*b*, 38*c*, and 38*d* that heat up the blanket cylinders 61*b*, 62*b*, 63*b*, and the heating lamps 36*a*, 36*b*, 36*c*, and 36*d* that heat up the images transferred from the blanket cylinders 61*b*, 62*b*, 63*b* onto the printing sheet S.

Therefore, in the printing units 61, 62, 63, and 64, by preheating the blanket cylinders 61*b*, 62*b*, 63*b* in advance by the preheating lamps 38*a*, 38*b*, 38*c*, and 38*d*, the heatset ink of the images formed on the surfaces of the blanket cylinders 61*b*, 62*b*, 63*b* by the inkjet heads 34*a*, 34*b*, 34*c*, and 34*d* is primarily dried, and the primary dry of the heatset ink of the images formed on the surfaces of the blanket cylinders 61*b*, 62*b*, 63*b* is kept when it is transferred onto the printing sheet S, and thereafter it is secondarily dried by the heating lamps 36*a*, 36*b*, 36*c*, and 36*d*, by which the ink does not penetrate into the printing sheet S so that the printing accuracy can be enhanced, and furthermore, it is possible to suppress the increase of cost without using expensive UV curing ink.

Seventh Embodiment

Figure 9:
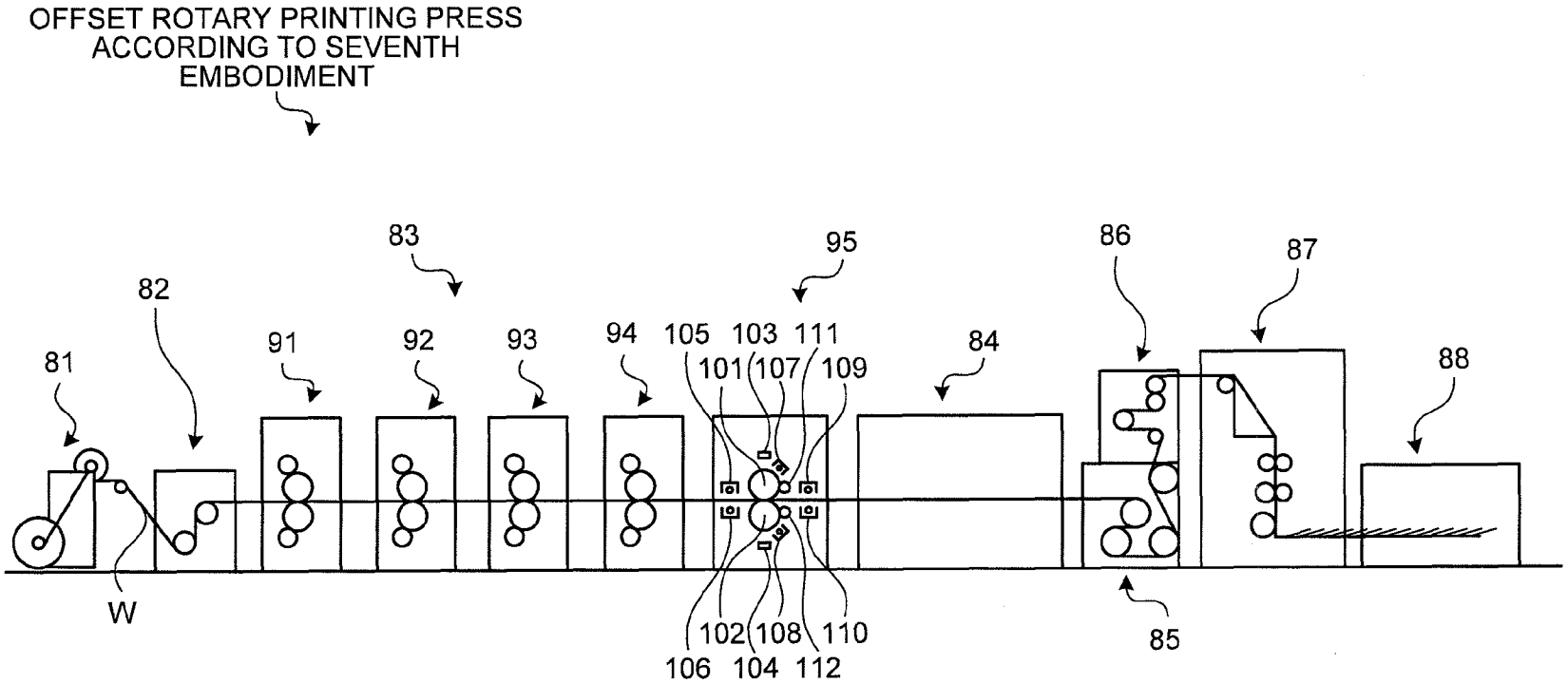
FIG. 9 is a schematic configuration diagram of a rotary printing press including a printing device according to a seventh embodiment of the present invention.

FIG. 9 is a schematic configuration diagram of a rotary printing press including a printing device according to a seventh embodiment of the present invention.

The rotary printing press according to the seventh embodiment is a rotary printing press using oil-based ink (heatset ink), which is constituted by, as shown in FIG. 9, a feeder device 81, an infeed device 82, a printing device 83, a drying device 84, a cooling device 85, a web pass device 86, a folding device 87, and a delivery device 88.

The feeder device 81 includes a reel stand on which two winding bodies (web rolls) are mounted and a paper splicer that can supply the web in a continuous manner by connecting a web (printing medium) W drawn from one winding body to a web of the other winding body. The infeed device 82 supplies the web W of the feeder device 81 to the printing device 83.

The printing device 83 is constituted by four printing units 91, 92, 93, and 94 for four-color inks (Black, Cyan, Magenta, and Yellow) and a printing unit 95 that performs printing using an inkjet head (described later) arranged along a web running direction. Each of the printing units 91, 92, 93, and 94 is a perfecting press that performs printing on a front surface and a back surface of the web W in a simultaneous manner, having virtually the same configuration with only difference in the color of ink used (Black, Cyan, Magenta, and Yellow). That is, in each of the printing units 91, 92, 93, and 94, a configuration in which an inkwell, an ink fountain roller, a delivery roller, a kneading roller, a reciprocating roller, and ink form roller, a plate cylinder, and a blanket cylinder are connected to each other in series is arranged up and down in a symmetrical meaner. When the web W passes between blanket cylinders facing each other, ink (print image) is transferred from the blanket cylinders onto both sides of the web W.

The printing unit 95 has virtually the same configuration as the printing device 13 explained in the third embodiment. That is, an upper blanket cylinder 101 and a lower blanket cylinder 102 are supported in a rotatable manner in contact with each other in the up-and-down direction, and the web W is conveyed by being nipped between the blanket cylinders 101 and 102. In the present embodiment, because the printing unit 95 is a perfecting press, the blanket cylinder 102 serves as the printing cylinder according to the present invention for the blanket cylinder 101, and the blanket cylinder 101 serves as the printing cylinder according to the present invention for the blanket cylinder 102.

On the outer peripheries of the blanket cylinders 101 and 102, inkjet heads 103 and 104 are provided, which form images on surfaces of the blanket cylinders 101 and 102, respectively, by squirting heatset ink. First preheating lamps (first heating units) 105 and 106 that heat up printing surfaces (both sides) of the web W are respectively provided on the upstream side from a contact portion of the blanket cylinders 101 and 102. On the outer peripheries of the blanket cylinders 101 and 102, second preheating lamps (first heating units) 107 and 108 that heat up surfaces of the blanket cylinders 101 and 102 are respectively provided. On the downstream side from the contact portion of the blanket cylinders 101 and 102, heating lamps (second heating units) 109 and 110 that heat up images (heatset ink) transferred from the blanket cylinders 101 and 102 onto the printing surfaces of the web W are respectively provided. In addition, on the outer peripheries of the blanket cylinders 101 and 102, cleaning rollers 111 and 112 that clean the surfaces of the blanket cylinders 101 and 102 are respectively provided.

The drying device 84 dries the ink on the web forming the image printed by the printing device 83, and the cooling device 85 cools down the web W that stores an excessive heat after drying by the drying device 84 to an appropriate temperature. The web pass device 86 conveys the web W that is dried and cooled down, the folding device 87 cuts the web W after folding the web W in the vertical direction and folds it in a predetermined size to form a quire, and the delivery device 88 delivers the folded quire to the outside.

A printing method using the offset rotary printing press according to the seventh embodiment with the above configuration is explained below.

The roll-shaped web W is first drawn from the winding body of the feeder device 81, and the web W is supplied to the printing device 83 by the infeed device 82. Subsequently, four-color printing of Black, Cyan, Magenta, and Yellow is performed on the web W by the four printing units 91, 92, 93, and 94 in the printing device 83. At this time, each of the printing units 91, 92, 93, and 94 performs the printing on a portion except for a predetermined area, and the printing unit 95 performs the printing on the predetermined white area.

That is, in the printing unit 95, the surfaces of the blanket cylinders 101 and 102 are preheated by the heats from the second preheating lamps 107 and 108, and the inkjet heads 103 and 104 form predetermined images on the surfaces of the blanket cylinders 101 and 102 by squirting the heatset ink onto the blanket cylinders 101 and 102 that are in the high-temperature condition, respectively. During the heatset ink is transferred onto the web W since it adheres to the blanket cylinders 101 and 102, the images (heatset ink) formed on the blanket cylinders 101 and 102 are dried, because the heats are applied from the blanket cylinders 101 and 102.

On the other hand, the printing surfaces of the conveyed web W are preheated by the heats from the first preheating lamps 105 and 106 before it is conveyed to the contact position of the upper and lower blanket cylinders 101 and 102. When the web W reaches the contact position of the blanket cylinders 101 and 102, the images of the blanket cylinders 101 and 102 are transferred onto the web W while the web W passes between the cylinders 101 and 102 with the cylinders 101 and 102 being pressed. At this time, the images (heatset ink) transferred onto the web W are dried by the heat applied from the web W in the high-temperature condition (primary dry, half dry). Thereafter, the images moved with the conveyance of the web W are subject to a secondary dry, i.e., fully dried, by the heats from the heating lamps 109 and 110.

The heatset ink remained on the surfaces of the blanket cylinders 101 and 102 from which the images on the surfaces are transferred onto the web W is removed by making contact with the cleaning rollers 111 and 112.

Thereafter, the web W on which the images are printed at the printing device 83 is sent to the drying device 84 from the printing device 83, cooled down at the cooling device 85, and conveyed to the folding device 87 via the web pass device 86 to form the quire, and then delivered by the delivery device 88.

In this manner, in the offset rotary printing press according to the seventh embodiment, the printing unit 95 is arranged on the downstream side of the printing units 91, 92, 93, and 94 for four-color printing, and the printing unit 95 includes the blanket cylinders 101 and 102 that are configured to make a synchronous rotation in contact with each other and to convey the web W by nipping the web W between them, the inkjet heads 103 and 104 that form the images on the surfaces of the blanket cylinders 101 and 102 by squirting the heatset ink onto the surfaces of the blanket cylinders 101 and 102, the first preheating lamps 105 and 106 that heat up the web W to be conveyed to the contact position of the blanket cylinders 101 and 102, the second preheating lamps 107 and 108 that heat up the blanket cylinders 101 and 102, and the heating lamps 109 and 110 that heat up the images transferred from the blanket cylinders 101 and 102 onto the web W.

Therefore, in the printing unit 95, the heatset ink of the images formed on the surfaces of the blanket cylinders 101 and 102 by the inkjet heads 103 and 104 are primarily dried by the inkjet head 34 is primarily dried by the heats applied from the blanket cylinders 101 and 102 in the high-temperature condition, and the heatset ink of the images formed on the surfaces of the blanket cylinders 101 and 102 are further primarily dried when they are transferred onto the web W by the heat from the web W in the high-temperature condition, and thereafter the images on the web W are secondarily dried by the heating lamps 109 and 110, by which the ink does not penetrate into the web W so that the printing accuracy can be enhanced, and furthermore, it is possible to suppress the increase of cost without using expensive UV curing ink.

Eighth Embodiment

Figure 10:
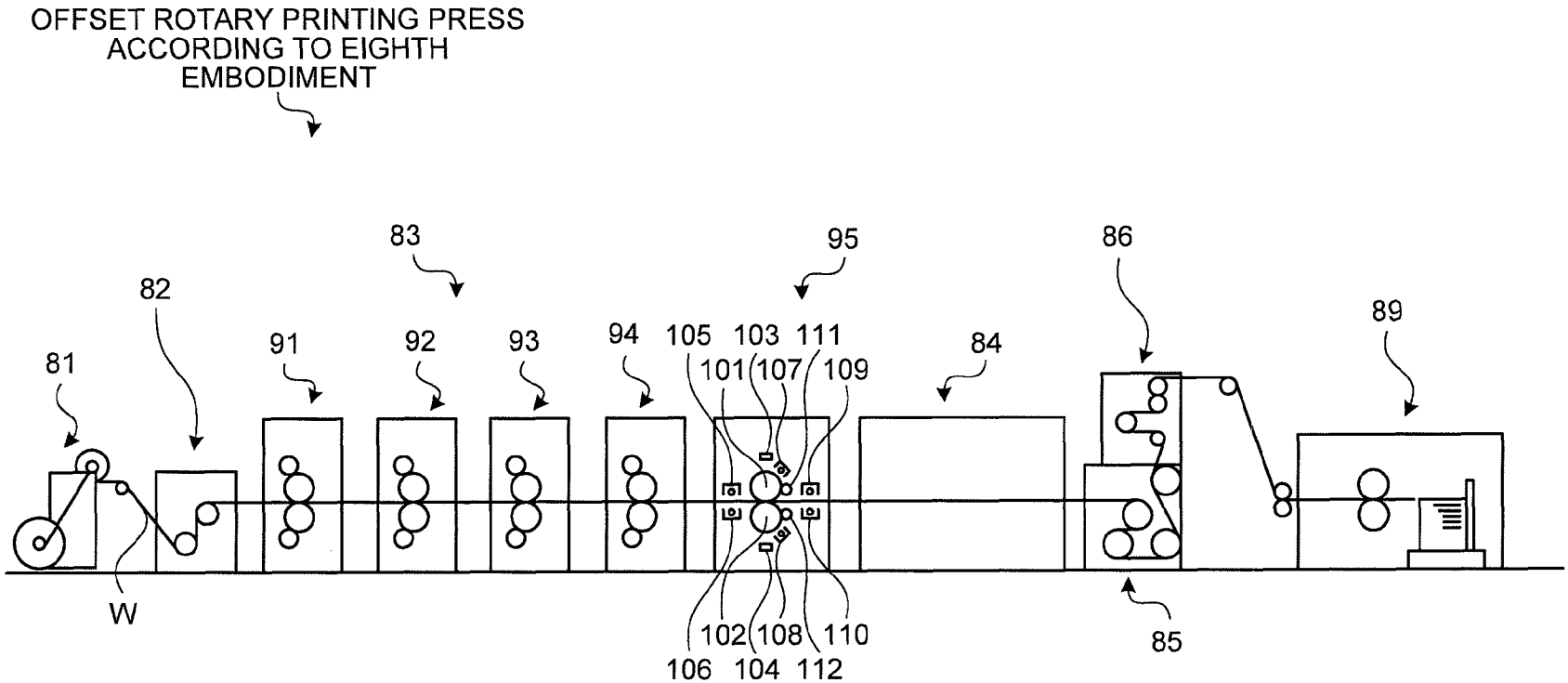
FIG. 10 is a schematic configuration diagram of a rotary printing press including a printing device according to an eighth embodiment of the present invention.

FIG. 10 is a schematic configuration diagram of a rotary printing press including a printing device according to an eighth embodiment of the present invention. Elements having the same functions as those described in the seventh embodiment described above are denoted by like reference signs and redundant explanations thereof will be omitted.

The rotary printing press according to the eighth embodiment is a rotary printing press using oil-based ink (heatset ink), which is constituted by, as shown in FIG. 9, the feeder device 81, the infeed device 82, the printing device 83, the drying device 84, the cooling device 85, the web pass device 86, and a sheeter 89. That is, the offset rotary printing press according to the eighth embodiment includes the sheeter 89 instead of the folding device 87 and the delivery device 88 of the offset rotary printing press according to the seventh embodiment, with the other configurations the same as that of the seventh embodiment. In this case, the sheeter 89 cuts the web W in a predetermined size and delivers them after stacking.

Because a printing method using the offset rotary printing press according to the eighth embodiment is different from that in the seventh embodiment only in a process of the web W by the sheeter 89 after printing, and processes by the feeder device 81, the infeed device 82, the printing device 83, the drying device 84, the cooling device 85, and the web pass device 86 are the same, and therefore explanations thereof will be omitted. Furthermore, because the operational effects by the printing device 83 are the same, explanations thereof will be also omitted.

Ninth Embodiment

Figure 11:
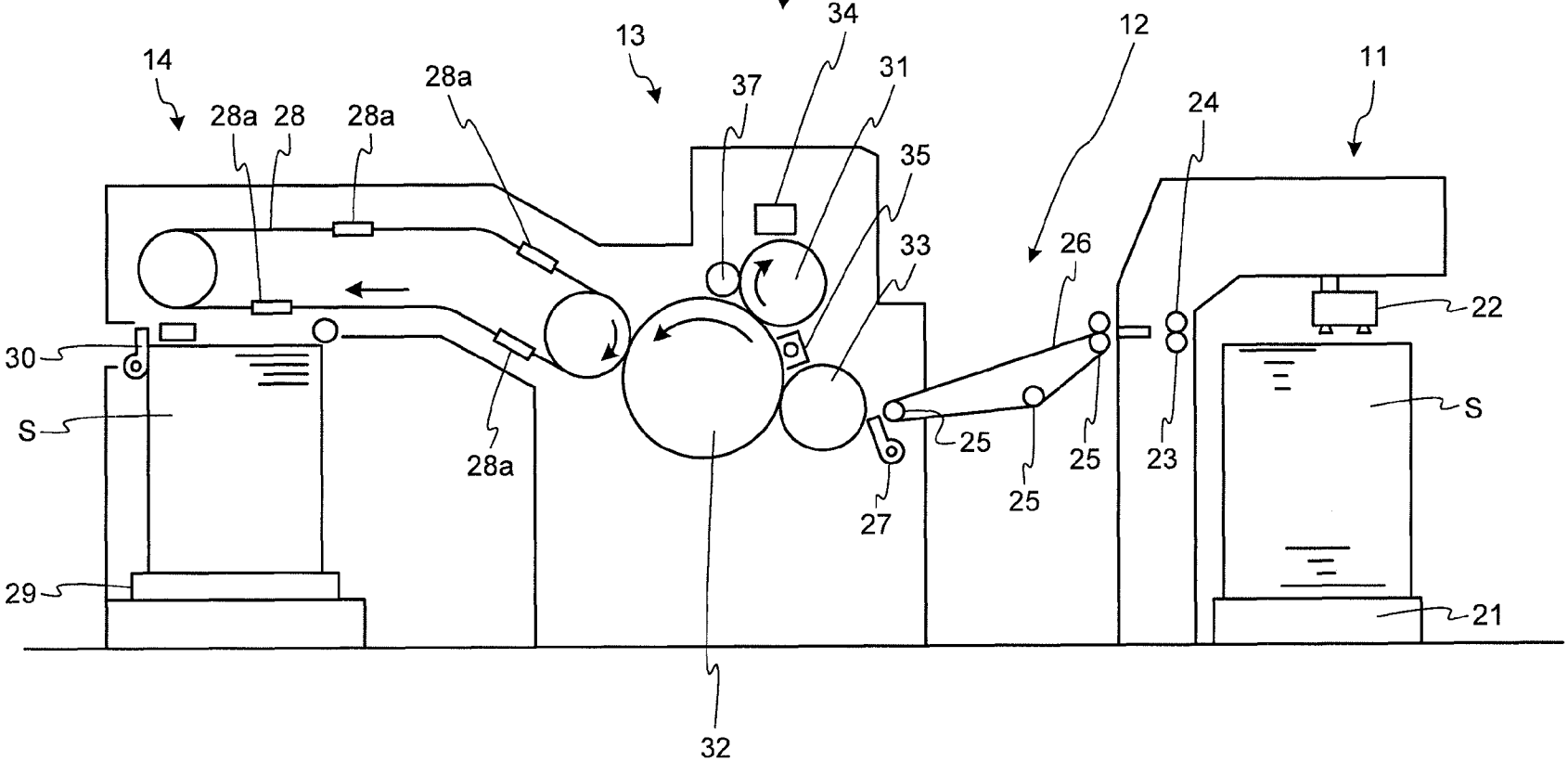
FIG. 11 is a schematic configuration diagram of a sheet-fed printing press including a printing device according to a ninth embodiment of the present invention.

FIG. 11 is a schematic configuration diagram of a sheet-fed printing press including a printing device according to a ninth embodiment of the present invention. Elements having the same functions as those described in the above embodiments are denoted by like reference signs and redundant explanations thereof will be omitted.

As shown in FIG. 11, the offset sheet-fed printing press according to the ninth embodiment is constituted by the feeder device 11, the conveying device 12, the printing device 13, and the delivery device 14. The feeder device 11, the conveying device 12, and the delivery device 14 have the same configurations as those of the first embodiment, and only the configuration of the printing device 13 is different.

Specifically, the printing device 13 according to the ninth embodiment is configured such that the heating lamp 36 as the second heating unit is removed from the first embodiment.

That is, in the printing device 13, on the outer periphery of the blanket cylinder 31, the inkjet head 34 is provided, which forms an image on a surface of the blanket cylinder 31 by squirting heatset ink. On the outer periphery of the impression cylinder 32, the first preheating lamp 35 is provided, being located on the upstream side of the rotation direction of the impression cylinder 32 from a contact position of the impression cylinder 32 and the blanket cylinder 31 and serving as a first heating unit that heats up a printing surface of a printing sheet S conveyed by the impression cylinder 32. In this case, the first preheating lamp 35 is either a halogen lamp or an infrared lamp, which is set to an output for fully drying the image of the heatset ink squirted from the inkjet head 34.

Therefore, in the printing device 13, the inkjet head 34 forms a predetermined image on the surface of the blanket cylinder 31 by squirting the heatset ink from a plurality of nozzles onto the blanket cylinder 31. The transfer cylinder 33 receives the printing sheet S sent from the conveying device 12, delivers it to the impression cylinder 32, and the printing surface of the printing sheet S is preheated by the heat from the preheating lamp 35 before the printing sheet S is conveyed by the impression cylinder 32 to a contact position with the blanket cylinder 31. When the printing sheet S is conveyed to the impression cylinder 32 and reaches the contact position of the blanket cylinder 31 and the impression cylinder 32, the image of the blanket cylinder 31 is transferred onto the printing sheet S while the printing sheet S passes between the cylinders 31 and 32 with the cylinders 31 and 32 being pressed. At this time, the image (heatset ink) transferred onto the printing sheet S is dried by the heat applied from the printing sheet S that is in the high-temperature condition.

Specifically, when the image of the blanket cylinder 31 is transferred onto the printing sheet S, the image (heatset ink) transferred onto the printing sheet S starts to be dried by the heat applied from the printing sheet S in the high-temperature condition. That is, the dry of the image on the printing sheet S starts after the heat is applied from the printing sheet S, the dry is progressed during the image moves with the rotation of the impression cylinder 32, and when reaching the delivery device 14, the dry is virtually completed.

In this manner, the offset sheet-fed printing press according to the ninth embodiment includes the rotatable impression cylinder 32, the blanket cylinder 31 that is configured to make a synchronous rotation with the impression cylinder 32 in contact with each other and to convey the printing sheet S by nipping the printing sheet S with the impression cylinder 32, the inkjet head 34 that forms an image on the surface of the blanket cylinder 31 by squirting the heatset ink onto the surface of the blanket cylinder 31, and the preheating lamp 35 that heats up the printing sheet S that is conveyed to the contact position of the blanket cylinder 31 and the impression cylinder 32.

Therefore, the heatset ink of the image formed on the surface of the blanket cylinder 31 is dried when it is transferred onto the printing sheet S that is in the high-temperature condition by the preheating lamp 35, by which the ink does not penetrate into the printing sheet S so that the printing accuracy can be enhanced, and furthermore, it is possible to suppress the increase of cost without using expensive UV curing ink.

Although the first preheating lamp 35 is used as the first heating unit that heats up the printing surface of the printing sheet S conveyed by the impression cylinder 32 in the ninth embodiment, it is not limited to this configuration. That is, instead of the first preheating lamp 35, the second preheating lamp 38 (see the third embodiment, FIG. 5) can be provided as the first heating unit that heats up the surface of the blanket cylinder 31.

In addition, because the drying device 84 dries the web W by heating it in the seventh and eighth embodiments described above, the heating lamps 109 and 110 can be removed by giving the function of the second heating unit (the heating lamps 109 and 110) to the drying device 84. Furthermore, although the printing device according to the present invention is configured as a part or whole of the printing devices in the offset sheet-fed printing press and the offset rotary printing press in the fifth to eighth embodiments described above, it is not limited to this configuration, but it can be set appropriately according to the printing scheme. Moreover, although the printing press is configured as the perfecting press or the single-side printing press in the above embodiments, it can be configured as any one of the printing presses.

Furthermore, although the printing medium is configured as the printing sheet S as cut paper and the web W as continuous paper in the above embodiments, the printing medium is not limited to the printing paper, but can be a resin film, a copper plate sheet or the like.

INDUSTRIAL APPLICABILITY

The printing device, the printing method, the sheet-fed printing press, and the rotary printing press according to the present invention achieve enhancement of the printing accuracy and suppression of the printing cost by transferring the heatset ink of the image formed on the blanket cylinder by the inkjet head onto the printing medium after primarily drying it, so that they can be applied to any one of printing presses of offset, gravure, flexography and the like.

REFERENCE SIGNS LIST

11, 41 feeder device
12, 42 conveying device
13, 43 printing device
14, 44 delivery device
31 blanket cylinder
32 impression cylinder (printing cylinder)
34, 34*a*, 34*b*, 34*c*, 34*d* inkjet head
35, 35*a*, 35*b*, 35*c*, 35*d* preheating lamp, first preheating lamp (first heating unit)
36, 36*a*, 36*b*, 36*c*, 36*d* heating lamp, second heating lamp (second heating unit)
37 cleaning roller (cleaning unit)
38, 38*a*, 38*b*, 38*c*, 38*d* preheating lamp, second preheating lamp (first heating unit)
39 heating lamp, first heating lamp (first heating unit)
61, 62, 63, 64, 65 printing unit (printing device)
81 feeder device
82 infeed device
83 printing device
84 drying device (second heating unit)
85 cooling device
86 web pass device
87 folding device
88 delivery device
89 sheeter
95 printing unit (printing device)
101, 102 blanket cylinder (printing cylinder)
103, 104 inkjet head
105, 106 first preheating lamp (first heating unit)

107, 108 second preheating lamp (first heating unit)
109, 110 heating lamp (second heating unit)
111, 112 cleaning roller (cleaning unit)

The invention claimed is:

1. A printing device comprising:

a rotatable printing cylinder;

a blanket cylinder configured to make a synchronous rotation with the printing cylinder in contact with each other and to convey a printing medium by nipping the printing medium with the printing cylinder;

an inkjet head that forms an image on a surface of the blanket cylinder by squirting heatset ink onto the surface of the blanket cylinder;

a preheating lamp that heats up a printing surface of the printing medium conveyed into a contact portion of the printing cylinder and the blanket cylinder before the image is transferred from the blanket cylinder, a first heating unit being disposed upstream of the inkjet head in a rotational direction of the blanket cylinder, such that the first heating unit heats up the blanket cylinder from an outer periphery of the blanket cylinder before the heatset ink is squirted from the ink jet head; and a preliminary heating unit that preliminarily heats up the image formed on the surface of the blanket cylinder.

2. The printing device according to claim 1, further comprising a second heating unit that heats up an image transferred from the blanket cylinder onto the printing medium.

3. The printing device according to claim 1, further comprising a cleaning unit that removes residual heatset ink remained on the surface of the blanket cylinder after the image formed on the surface of the blanket cylinder is transferred onto the printing medium.

4. A printing method comprising:

heating up a blanket cylinder from an outer periphery of the blanket cylinder before a heatset ink is squirted;

heating a printing medium conveyed into a contact portion of the blanket cylinder and a printing cylinder;

forming an image on a surface of the blanket cylinder by squirting heatset ink onto the surface of the blanket cylinder;

heating up preliminarily the image formed on the surface of the blanket cylinder; and transferring the image formed on the blanket cylinder onto the printing medium at the contact portion of the blanket cylinder and the printing cylinder.

5. The printing method according to claim 4, further comprising drying the image transferred onto the printing medium by heating the image.

6. A sheet-fed printing press comprising:

a feeder device that sucks and sends out cut paper stacked on a feeder pile board;

a printing device that conveys the cut paper sent from the feeder device by nipping the cut paper between a printing cylinder and a blanket cylinder and performs printing by transferring an image formed on the blanket cylinder onto the cut paper; and a delivery device that delivers the cut paper on which the printing is performed by the printing device by stacking the cut paper on a delivery pile board, wherein the printing device includes an inkjet head that forms the image on a surface of the blanket cylinder by squirting heatset ink onto the surface of the blanket cylinder, a preheating lamp that heats up a printing surface of the printing medium conveyed into a contact portion of the printing cylinder and the blanket cylinder before the image is transferred from the blanket cylinder, a first heating unit being disposed upstream of the inkjet head ina rotational direction of the blanket cylinder, such that the first heating unit heats up the blanket cylinder from an outer periphery of the blanket cylinder before the heatset ink is squirted from the ink jet head; and a preliminary heating unit that preliminarily heats up the image formed on the surface of the blanket cylinder.

7. A rotary printing press comprising:

a feeder device that supplies a web from a paper roll;

a printing device that conveys the web sent from the feeder device by nipping the web between a printing cylinder and a blanket cylinder and performs printing by transferring an image formed on the blanket cylinder onto the web;

a drying device that dries the web on which the printing is performed by the printing device;

a folding device that cuts the web dried by the drying device and folds a cut web to form a quire; and a delivery device that delivers the quire formed by the folding device, wherein the printing device includes an inkjet head that forms the image on a surface of the blanket cylinder by squirting heatset ink onto the surface of the blanket cylinder, a preheating lamp that heats up a printing surface of the printing medium conveyed into a contact portion of the printing cylinder and the blanket cylinder before the image is transferred from the blanket cylinder, a first heating unit being disposed upstream of the inkjet head in a rotational direction of the blanket cylinder, such that the first heating unit heats up the blanket cylinder from an outer periphery of the blanket cylinder before the heatset ink is squirted from the ink jet head; and a preliminary heating unit that preliminarily heats up the image formed on the surface of the blanket cylinder.

* * * * *